US006868253B2

(12) United States Patent
Ueda et al.

(10) Patent No.: US 6,868,253 B2
(45) Date of Patent: Mar. 15, 2005

(54) IMAGE FORMING APPARATUS WHICH CONVEYS AN IMAGE-FORMED SHEET TO REVERSE THE SHEET AND CONVEYS THE SHEET TO A FOLDING UNIT WHEN A THREE-FOLD PROCESS OF FOLDING A LOWER SURFACE IS SELECTED

(75) Inventors: Akio Ueda, Tokyo (JP); Masaru Ushio, Tokyo (JP); Yasumasa Tsukamoto, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/325,155

(22) Filed: Dec. 20, 2002

(65) Prior Publication Data

US 2003/0123894 A1 Jul. 3, 2003

(30) Foreign Application Priority Data

Dec. 27, 2001 (JP) ..... 2001-396738

(51) Int. Cl.[7] ..... G03G 15/00
(52) U.S. Cl. ..... 399/407; 270/20.1; 399/81
(58) Field of Search ..... 399/82, 81, 407, 399/408, 410; 270/20.1, 39.01

(56) References Cited

U.S. PATENT DOCUMENTS 5,768,677 A * 6/1998 Natsume ..... 399/407
6,006,065 A * 12/1999 Seki ..... 399/407
6,027,107 A * 2/2000 Natsume et al. ..... 399/410
6,029,026 A * 2/2000 Natsume et al. ..... 399/82
6,076,817 A * 6/2000 Kobayashi et al. ..... 399/408
6,526,256 B2 * 2/2003 Yoshie et al. ..... 399/407

FOREIGN PATENT DOCUMENTS

JP 08301511 A * 11/1996 ..... B65H/37/04
JP 2001058758 A * 3/2001 ..... B65H/45/04
JP 2003-81218 3/2003
JP 2003-122074 4/2003

* cited by examiner

*Primary Examiner*—Susan Lee
(74) *Attorney, Agent, or Firm*—Frishauf, Holtz, Goodman & Chick, P.C.

(57) ABSTRACT

An image forming apparatus includes an image forming apparatus body, an image reading apparatus mounted on the upper portion of the apparatus body, and a postprocessing apparatus having a folding unit which folds a sheet. The image forming apparatus includes a selection window which is formed on an operation display unit of the image forming apparatus body and allows selection of a fold surface of a sheet. The selection window displays a three-fold process of folding an upper surface on which an image is formed and a three-fold process of folding a lower surface on which no image is formed.

11 Claims, 18 Drawing Sheets

IMAGE FORMING APPARATUS WHICH CONVEYS AN IMAGE-FORMED SHEET TO REVERSE THE SHEET AND CONVEYS THE SHEET TO A FOLDING UNIT WHEN A THREE-FOLD PROCESS OF FOLDING A LOWER SURFACE IS SELECTED

BACKGROUND OF THE INVENTION

1. Field of the Invention

The present invention relates to an image forming apparatus such as an electrophotographic copying machine or printer.

2. Description of the Prior Art

The present invention applicant has already proposed postprocessing apparatuses in Japanese Patent Application Nos. 2001-318075 and 2001-281315, which collate many sheets on which images are formed by an image forming apparatus body having an electrophotographic copying machine, printer, or the like for each print count, and bookbind the sheets by binding them together by using binding means or perform a three-fold process.

This postprocessing apparatus is connected to the image forming apparatus body and can perform predetermined postprocessing for sheets on which images are formed by the image forming apparatus body.

The predetermined postprocessing includes binding processes, folding processes, and the like. More specifically, the binding processes include an end binding process performed by a binding means to bind the end portions of sheets together and a saddle stitching process performed by the binding means to bind the middle portions of sheets together. The folding processes include a center folding process of folding a sheet along its center and a three-fold process of folding a sheet in three.

In the above folding process, in order to perform predetermined postprocessing for sheets on which images are formed by the image forming apparatus body, a predetermined convey method is used as a method of conveying the image-formed sheets to the postprocessing apparatus.

As a form of delivering a sheet from the image forming apparatus body to the postprocessing apparatus, either one of the following forms of delivery is used: face-up delivery of delivering the sheet with its image-formed surface facing up; and facedown delivery of delivering the sheet with its image-formed surface facing down.

In the above three-fold process as well, therefore, sheets are delivered with facing down for the three-fold process that is performed with a high frequency as in the case of letters inserted in envelopes, and each sheet is folded in three with the image-formed surface (upper surface) facing outward, ire., the non-image surface (lower surface) facing inward.

Although a three-fold process can be performed for letters and the like, a letter to be inserted into an envelope is preferably folded in three with its image-formed surface (upper surface) facing inward. However, such a three-fold process for letters and the like cannot be done.

That is, the conventional apparatus can perform a three-fold process only in one form, but cannot perform it with an arbitrary one of the upper and lower surfaces of a sheet facing inward.

SUMMARY OF THE INVENTION

The present invention has been made in consideration of the above problems in the prior art, and has as its object to provide an image forming apparatus which can perform a three-fold process for a sheet conveyed to a postprocessing apparatus from either of the surfaces of the sheet.

In order to achieve the above object, according to the main aspect of the present invention, there is provided an image forming apparatus including an image forming apparatus body, an image reading apparatus mounted on an upper portion of the apparatus body, and a postprocessing apparatus having a folding unit which folds a sheet, comprising a selection window which is formed on an operation display unit of the image forming apparatus and allows selection of a fold surface of a sheet.

The image forming apparatus according to the main aspect has the following secondary aspects.

The folding unit performs a three-fold process. The selection window displays a three-fold process of folding an upper surface on which an image is formed and a three-fold process of folding a lower surface on which no image is formed.

This apparatus further comprises control means for conveying an image-formed sheet to a reversing unit for reversing the sheet and/or to the folding unit, the control means performing control to reverse the sheet and conveying the sheet to the folding unit when the three-fold process of folding a lower surface is selected from the selection window.

When the three-fold process of folding an upper surface is selected from the selection window, the control means performs control to convey the sheet to the folding unit without reversing the sheet.

As is obvious from the respective aspects described above, according to the image forming apparatus of the present invention, a sheet conveyed to the postprocessing apparatus can be folded in three from either the upper surface or the lower surface.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

Several preferred embodiments of the present invention will be described below with reference to the accompanying drawings.

Figure 1:
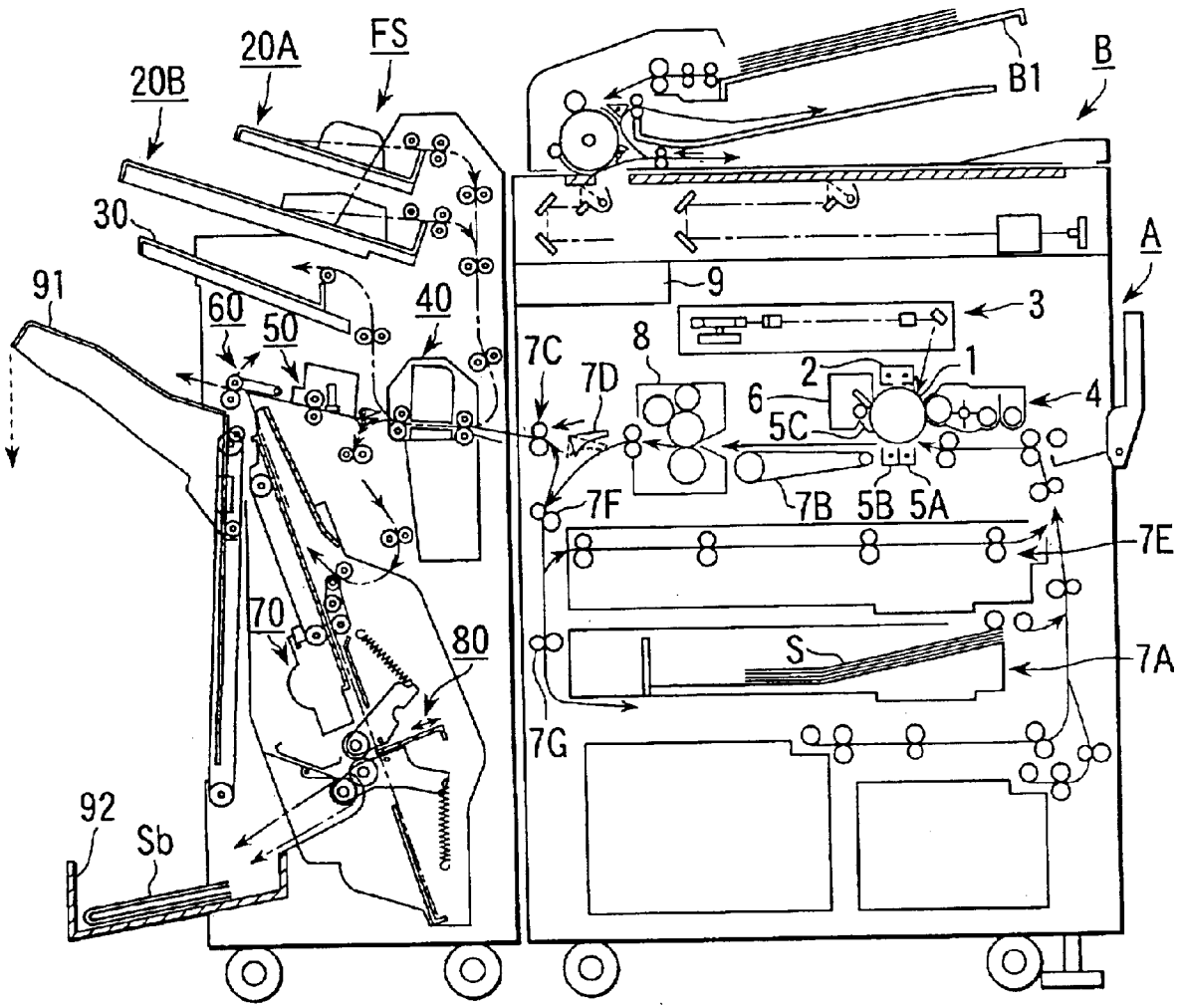
FIG. 1 is a view schematically showing the overall arrangement of an image forming apparatus according to the present invention which is comprised of an image forming apparatus body, image reading apparatus, and postprocessing apparatus.

Referring to FIG. 1 showing the overall arrangement of an image forming apparatus having an image forming apparatus body A, image reading apparatus B, and postprocessing apparatus FS, the image forming apparatus body A has an image forming portion in which a charging means 2, image exposing means (write means) 3, developing means 4, transfer means 5A, discharging means 5B, separating pawl 5C, and cleaning means 6 are arranged around a rotating photosensitive body 1. The surface of the photosensitive body 1 is uniformly charged by the charging means 2. After that, the surface of the photosensitive body 1 is exposed and scanned by a laser beam from the image exposing means 3 on the basis of image data read from the original, thus forming a latent image. The latent image undergoes reversal development by the developing means 4, thus forming a toner image on the surface of the photosensitive body 1.

A sheet S fed from a sheet storing means 7A is sent to the transfer position. At the transfer position, the toner image is transferred onto the sheet S by the transfer means 5A. Thereafter, charges on the lower surface of the sheet S are erased by the discharging means 5B. The sheet S is separated from the photosensitive body 1 by the separating pawl 5C, conveyed by an intermediate convey unit 7B, successively heated and fixed by a fixing means 8, and delivered by a delivery means 7C.

When the postprocessing apparatus FS is to perform a three-fold process for the sheet S, the sheet S heated/fixed by the fixing means 8 is branched from the ordinary delivery path by a convey path switching plate 7D, guided halfway by a reverse convey roller 7G through a convey roller 7F, and switched back. The trailing end of the sheet S is then raised, and the sheet S is delivered outside the image forming apparatus body A from the delivery unit 7C with the image-formed surface (upper surface), i.e., the image-formed surface on which the toner image is fixed, facing down. The sheet S delivered from the delivery unit 7C is conveyed to the postprocessing apparatus FS.

A developing agent remaining on the surface of the photosensitive body 1 after image formation is removed by the cleaning means 6 downstream of the separating pawl 5C, so the photosensitive body 1 prepares for the next image formation.

A display unit formed from a liquid crystal display screen unit which displays the modes and the like of the postprocessing apparatus and serves as a touch panel that allows an operator to select the mode and perform inputting/selecting operation and an operation display unit 9 having other buttons are arranged on the upper front surface side of the image forming apparatus body A.

The image reading apparatus B having an automatic document feeder which reads an original while moving it is set on the upper portion of the image forming apparatus A.

Figure 2:
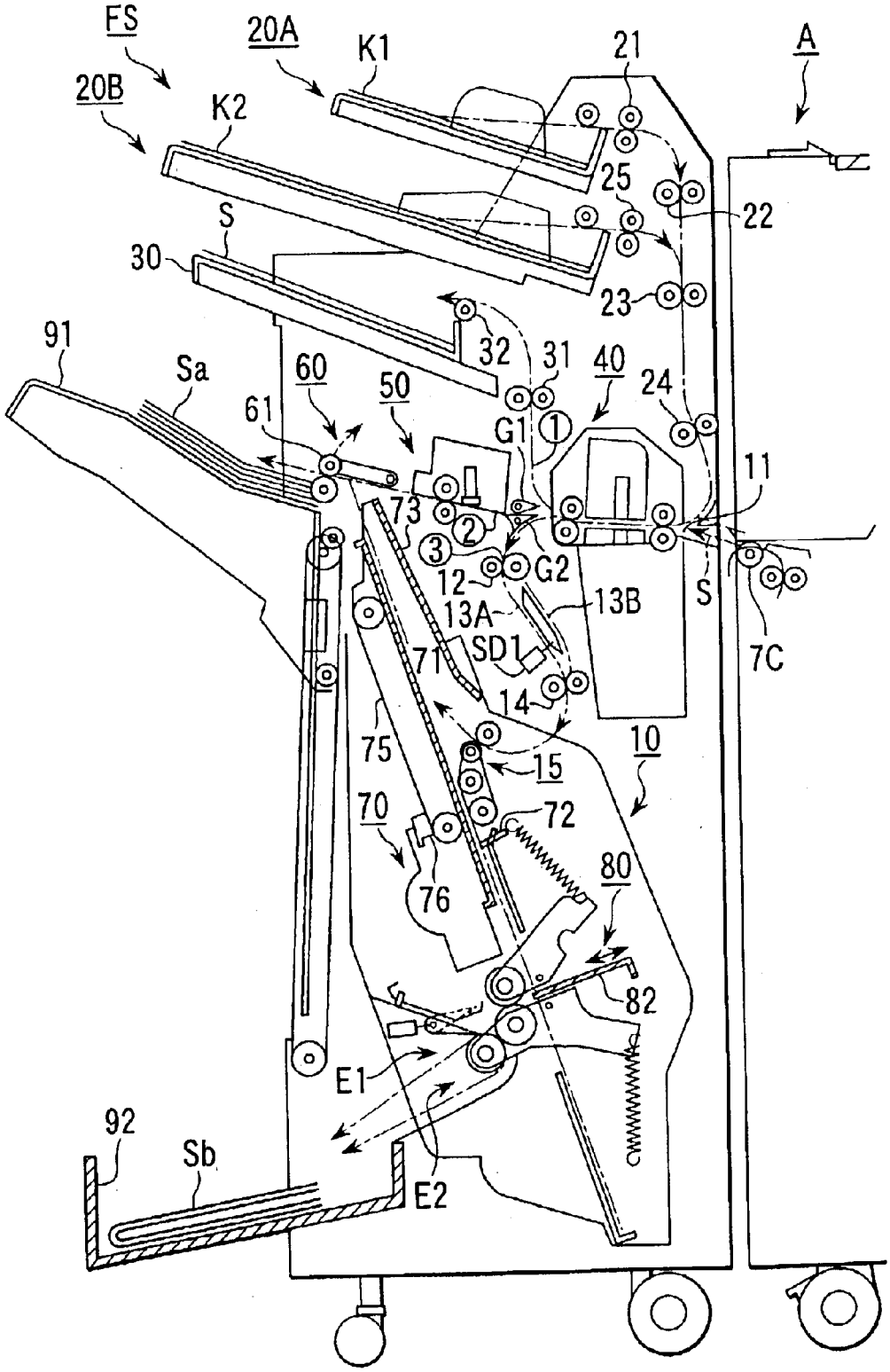
FIG. 2 is an enlarged view showing the arrangement of the postprocessing apparatus in which sheet convey paths are shown.

FIG. 2 shows sheet convey paths in the postprocessing apparatus FS. As shown in FIG. 2, in the postprocessing apparatus FS, a first feeding means 20A, second feeding means 20B, and stationary delivery table 30 are arranged at the upper stage. A punching means 40, shift means 50, and delivery means 60 are arranged in series at the intermediate stage to form one substantially horizontal plane. A binding unit 70 and folding unit 80 are arranged in series at the lower stage to form one inclined plane.

A vertically movable delivery table 91 for stacking shifted sheets S and a bundle of end-bound sheets Sa thereon, and a stationary delivery table 92 for stacking a bundle of sheets Sb folded in three or two are arranged on the left side surface, in FIG. 2, of the postprocessing apparatus FS.

Figure 18:
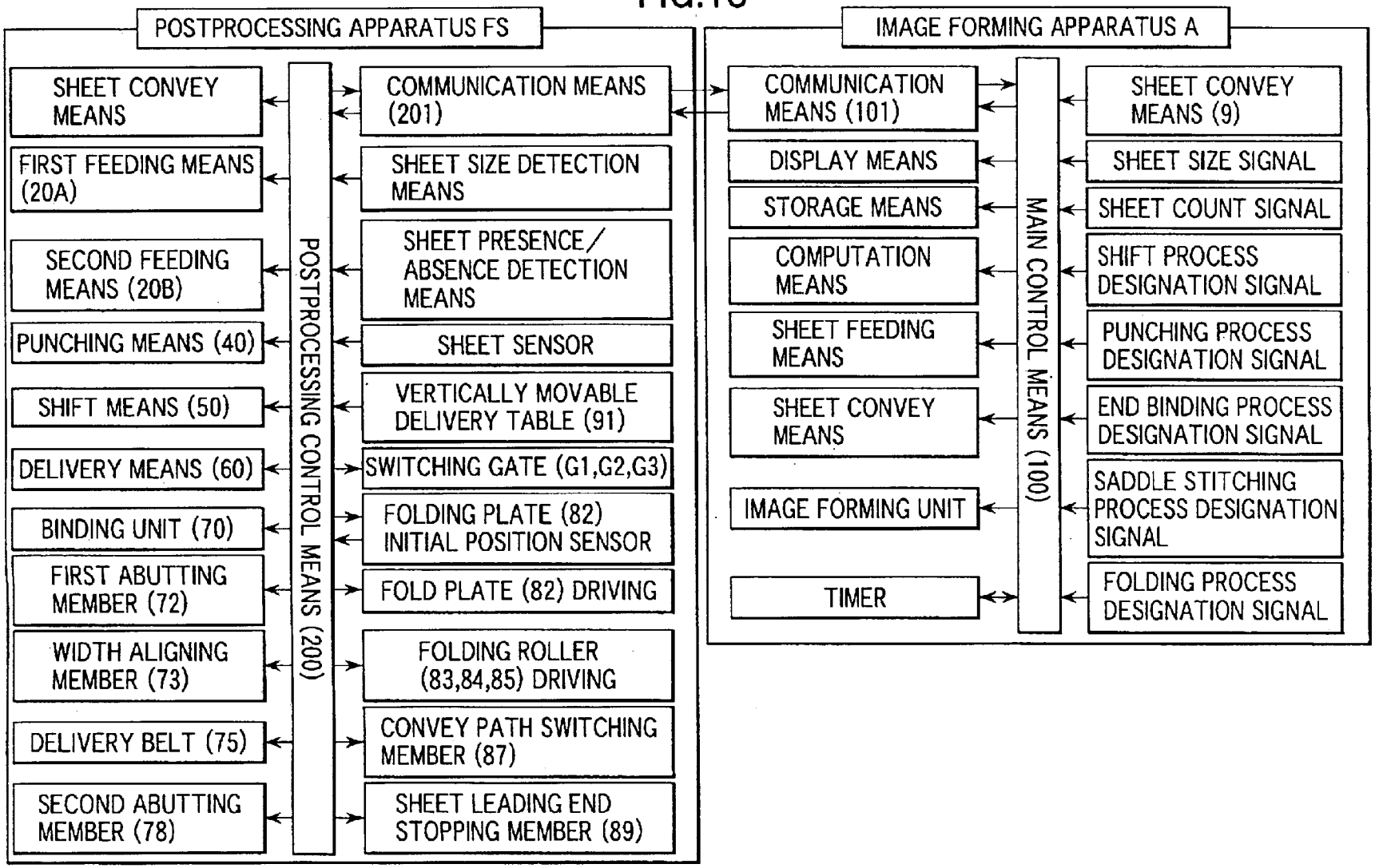
FIG. 18 is a block diagram showing control performed by the imaging forming apparatus body and postprocessing apparatus.

The image forming apparatus body A and postprocessing apparatus FS are controlled in the manner shown in FIG. 18.

Referring to FIG. 18, a communication means 101 of a main control means 100 of the image forming apparatus body A is electrically connected to a communication means 201 of a postprocessing control means 200 of the postprocessing apparatus FS to mutually exchange control signals.

By using a selection means of the operation display unit 9, the operator sets the following processes: a sheet feed process by the first and second feeding means 20A and 20B of the postprocessing apparatus FS, a punching process by the punching means 40, a shift process by the shift means 50, end binding and saddle stitching processes by the binding unit 70, and center folding and three-fold processes by the folding unit 80.

The main control means 100 sends a control signal to the postprocessing apparatus FS via the communication means 101. The control signal is transferred to the postprocessing control means 200 via the communication means 201. The postprocessing control means 200 drives each of the set means and associated means.

The control means according to the present invention is comprised of the above main control means 100 and postprocessing control means 200.

The position and height of the postprocessing apparatus FS shown in FIG. 2 are adjusted such that a receiving unit 11 for the sheet S delivered from the image forming apparatus body A coincides with the delivery unit 7C of the image forming apparatus body A.

The receiving unit 11 receives the sheet S having undergone image formation processing which is supplied from the image forming apparatus body A, insert paper K1 that separates sheet bundles from each other and is fed from the first feeding means 20A, and cover paper K2 fed from the second feeding means 20B.

The insert paper K1 stored in the sheet tray of the first feeding means 20A is separated and fed by a feeding unit 21 and then clamped by convey rollers 22, 23, and 24 so it is introduced to the receiving unit 11. The cover paper K2 stored in the sheet tray of the second feeding means 20B is separated and fed by a feeding unit 25 and then clamped by the convey rollers 23 and 24 so it is introduced to the receiving unit 11.

A sheet branching means comprised of switching means (also referred to as switching gates) G1 and G2 is formed downstream of the punching means 40 in the sheet convey direction. The switching means G1 and G2 select, as a sheet convey path, one of sheet convey paths in three directions by the driving operation of a solenoid (not shown), that is, to either one of a first convey path ① serving as an upper delivery path, a second convey path ② serving as an intermediate delivery path, and a third convey path ③ serving as a lower delivery path.

Each processing mode in the image forming apparatus according to the present invention will be described next.

Ordinary Delivery Mode:

Referring to FIG. 2, when the delivery mode is set, the switching means G1 closes the second convey path ② and third convey path ③ and opens only the first convey path ①.

The sheets S passing through the first convey path ① move upward as they are clamped by convey rollers 31, are delivered by a delivery roller 32, and are placed on the stationary delivery table 30, so they are sequentially stacked on it.

About 200 sheets S at maximum can be stacked on the stationary delivery table 30.

Shift Processing Mode:

When the shift processing mode is set, the switching means G1 retreats upward, and the switching means G2 closes the third convey path ③ and opens the second convey path ② to enable passing of the sheet S. The sheet S passes through the sheet path formed between the switching means G1 and G2.

The image-formed sheet S delivered from the image forming apparatus body A, the insert paper K1 fed from the first feeding means 20A, or the cover paper K2 fed from the second feeding means 20B passes through the intermediate sheet path between the switching means G1 and G2, is shifted by the shift means 50 by a predetermined amount in a direction perpendicular to the sheet convey direction, and is conveyed in the delivery direction.

The shift means 50 performs the shift process of changing the delivery position of the sheet S in the convey width direction every time a predetermined number of sheets are delivered. The shift-processed sheets S are delivered by the delivery means 60 to the vertically movable delivery table 91 outside the apparatus and are sequentially stacked on it. When a large number of sheets S are to be delivered, the vertically movable delivery table 91 gradually moves down. The vertically movable delivery table 91 can store about 3,000 (A4 or B5) sheets S at maximum.

Sort Mode:

When the sort mode is set, the switching means G1 closes the first convey path ① and third convey path ③ and opens only the second convey path ②.

The image-formed sheets S supplied from the photosensitive body 1 upon being reversed or not reversed are conveyed to the second convey path ②, are delivered to the vertically movable delivery table 91 outside the apparatus by the delivery means 60, and are sequentially stacked on it.

Binding Mode

The binding mode in the image forming apparatus according to the present invention will be described with reference to FIG. 3.

When saddle stitching (stapler), which is one of the binding modes (shown in FIG. 12) or one of the folding processes (center folding and three-fold processes) is set in the operation display unit 9 (see FIG. 1) having a display portion formed from a liquid crystal display screen portion, the image-formed sheet S conveyed into the receiving unit 11 of the postprocessing apparatus FS after an image formed on it in the image forming apparatus body A passes through the punching means 40 (see FIG. 2), is conveyed into the third convey path ③ below the switching means G2, and is conveyed downward as it is clamped between convey rollers 12.

Figure 3:
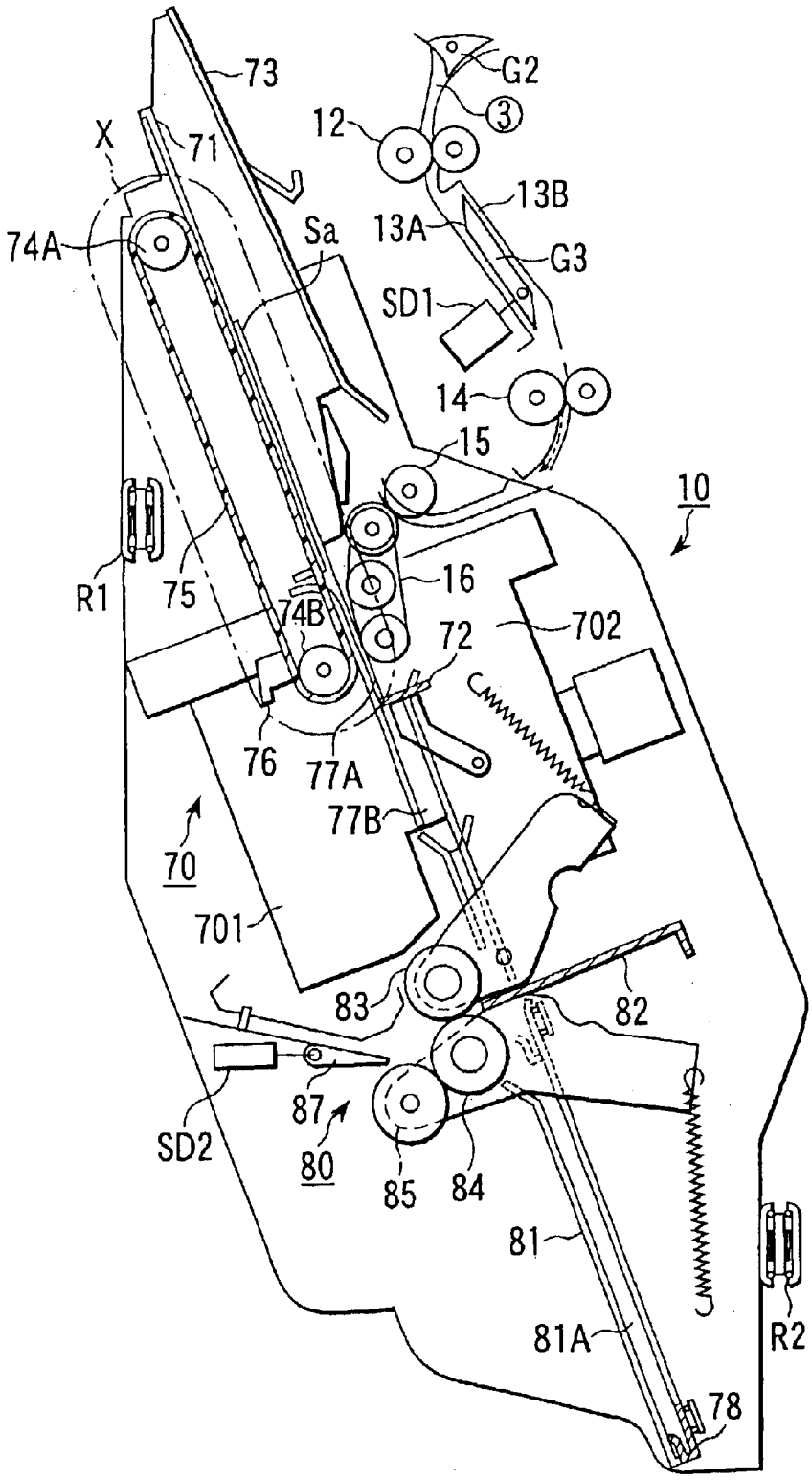
FIG. 3 is a sectional view showing a binding unit and folding unit in the postprocessing apparatus.

"When the sheet S with a size larger than A4 or B5 is to be conveyed along the third convey path ③, a solenoid SD1 is driven, so the sheet S passes through a sheet path 13A on the left side of the switching means (also referred to as a switching gate) G3 in FIG. 3, and is conveyed downward as it is clamped by convey rollers 14.

The sheet S is then clamped and fed by pair of inlet convey rollers 15 on the further downstream side, and is delivered to a space above a stacker 71 which is inclined. The sheet S comes into contact with the stacker 71 or the upper surface of the sheets S stacked on the stacker 71, and is conveyed obliquely upward.

After the trailing end of the sheet S in the traveling direction is delivered from the clamping position of the pair of convey rollers 15, the sheet S starts to move downward due to its own weight. The sheet S is conveyed on the inclined surface of the stacker 71, and is stopped when its trailing end abuts against the sheet abutting surface of a first abutting member 72 which is a sheet trailing end abutting member for end binding located near the binding means (staple means) constituted by a stapling mechanism 701 and staple receiving mechanism 702.

Reference numeral 16 denotes a winding belt in the form of an endless belt serving as a sheet guide member, which comes into slidable contact with the leading end of the sheet S to wind it, and feeds it to the first abutting member 72 as it pivots. Note that the sheet guide member 16 may be a rotatable impeller.

In order to improve the copy productivity by efficiently and continuously conveying the small-size sheets S such as A4 or B5 along the third convey path ③, the movable switching means G3 and a sheet convey path 13B parallel to the sheet convey path 13A on the left side of the switching means G3 in FIG. 3 are formed.

When the solenoid SD1 connected to the switching means G3 is driven, it closes the sheet convey path 13A and opens the sheet convey path 13B.

The leading end of the first small-size sheet S fed from the convey rollers 12 passes through the sheet convey path 13B, and stops upon abutting against the outer surfaces of the pair of inlet convey rollers 15 in a halt condition.

The solenoid SD1 is then turned off, and the distal end portion of the switching means G3 swings clockwise to close the sheet convey path 13B and open the sheet convey path 13A. The leading end of the second sheet S fed from the convey rollers 12 passes through the sheet convey path 13A and stops upon abutting against the outer surfaces of the pair of inlet convey rollers 15 in a halt condition.

Accordingly, near the clamping position of the pair of inlet convey rollers 15, the first and second sheets S are stopped with their leading ends being stacked on each other, so the sheets S are set in the wait state.

The pair of inlet convey rollers 15 are rotatably driven at a predetermined timing, to clamp and convey the two sheets S simultaneously, thus delivering them onto the stacker 71. From the third sheet, the pair of inlet convey rollers 15 deliver the sheets S one by one.

Reference numeral 73 denotes a pair of upstream width aligning members movably formed on the two side surfaces of stacker 71. The width aligning members 73 can move in a sheet width direction perpendicular to the sheet convey direction. In the sheet accepting mode wherein the sheet S is to be conveyed onto the stacker, 71, the width aligning members 73 are opened wider than the sheet width.

When the sheet S is conveyed on the stacker 71 and abuts against the first abutting member 72 so it is stopped there, the width aligning members 73 lightly strike the sides of the sheet S in the widthwise direction to jog the width of a bundle Sa of sheets (width alignment). At this stop position, when a predetermined number of sheets S are stacked and aligned on the stacker 71, the binding means constituted by the stapling mechanism 701 and staple receiving mechanism 702 performs a binding process, so the bundle Sa of sheets is bound together.

A notch is formed in part of the sheet stacking surface of the stacker 71, and a delivery belt 75 wound on a driving pulley 74A and driven pulley 74B is pivotally driven.

A delivery pawl 76 is integrally formed on part of the delivery belt 75, and its distal end forms an elliptic trace X, as indicated by the chain line in FIG. 3. The stitched bundle Sa of sheets is placed on the delivery belt 75 as the trailing ends of the sheets S are held by the delivery pawl 76 of the delivery belt 75. The sheets S slide on the sheet stacking surface of the stacker 71 and are pushed obliquely upward to travel to the clamping position of delivery rollers 61 (see FIG. 2) of the delivery means 60.

The bundle Sa of sheets clamped by the rotating delivery rollers 61 is delivered onto the vertically movable delivery table 91 and stacked there. (see FIG. 2).

The stacker 71 on which the sheet bundle Sa is placed, the binding unit 70, and the folding unit 80 are arranged on the frame of a postprocessing unit 10, and are guided by slide rails R1 and R2 to be withdrawn to the front side of the postprocessing apparatus FS.

Saddle Stitching Mode

The binding means has a two-division structure constituted by the stapling mechanism 701 and staple receiving mechanism 702, and a sheet convey path 77A through which the sheet S can pass is formed between them.

Two sets of binding means are arranged in the sheet width direction perpendicular to the sheet convey direction, and can be moved in the sheet-width direction by driving means (not shown).

When the saddle stitching mode is set, the first abutting member 72 near the binding positions (stapling positions of the staples) of the binding means retreats from the convey path. Almost simultaneously, a second abutting member 78 serving both as a saddle-stitching member and a center-folding member located downstream of the first abutting member 72 moves toward the extension surface of the sheet convey path 77A to close the sheet convey path 77B.

When the sizes (lengths in the convey direction) of the cover paper K2 and sheets S are set or detected, a saddle-stitching stopper unit having the second abutting member 78 moves to a position where it abuts against the lower end of the bundle Sa of sheets to be saddle-stitched, and stops.

After the cover paper K2 is placed at a predetermined stop position on the stacker 71, the sheets S unloaded from the image forming apparatus A pass through the third convey path ③ from the receiving unit 11 of the postprocessing apparatus FS and are sequentially stacked on the upper surface of the cover paper K2 placed on the stacker 71. The leading ends of the sheets S abut against the second abutting member 78 to be positioned.

After the last sheet S is positioned and placed on the stacker 71, the sheet bundle Sa constituted by the cover paper K2 and all pages of the sheets S are saddle-stitched by the binding means.

By means of this saddle stitching process, the cover paper K2 and sheets S are bound with the staple SP at their middle portions in the convey direction. The staple SP is inserted by the stapling mechanism 701 on the staple driving side toward the staple receiving mechanism 702 on the staple clinch side.

Folding Mode

The folding mode in the image forming apparatus according to the present invention will be described with reference to FIG. 4.

Figure 4:
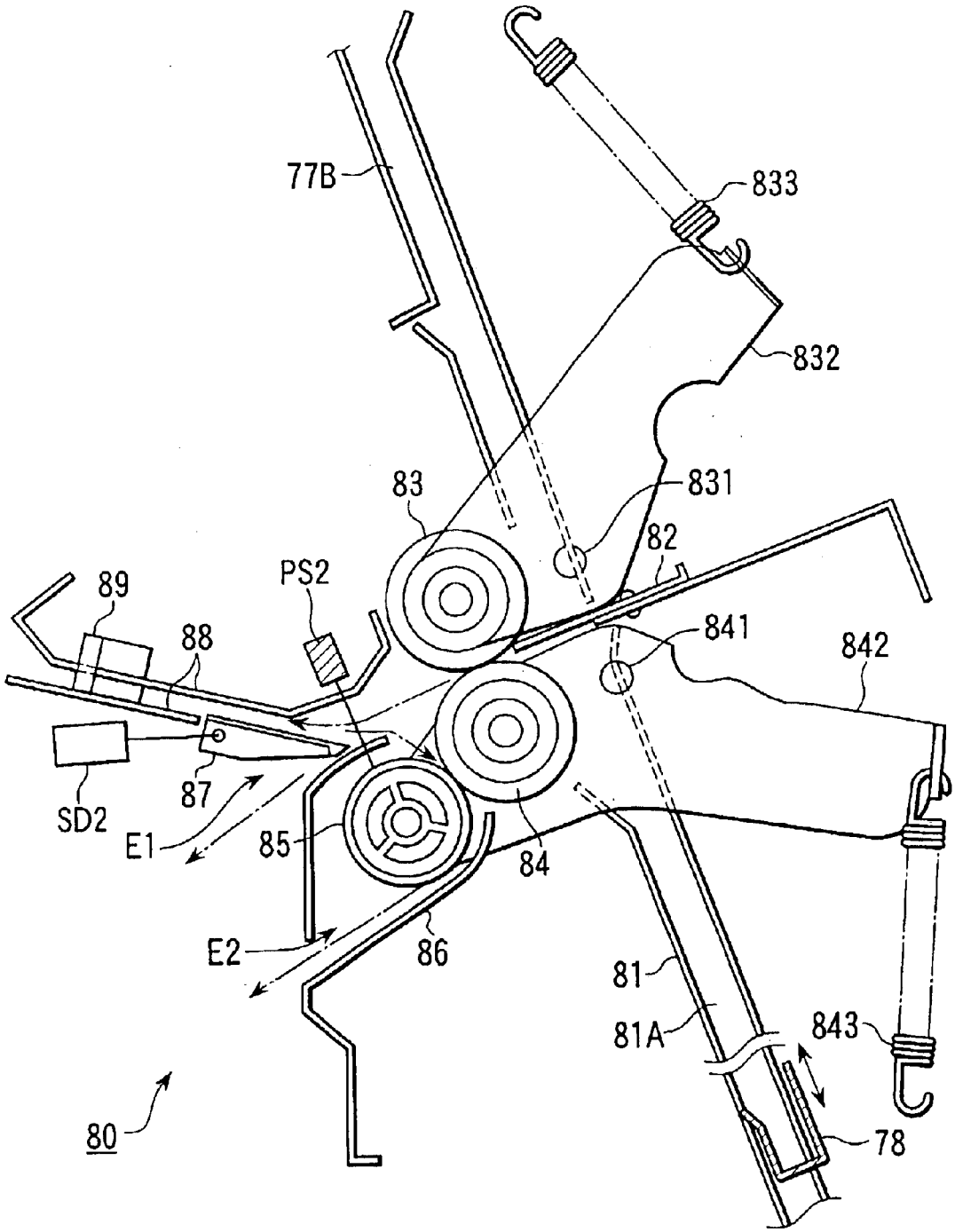
FIG. 4 is an enlarged front view of the folding unit in the postprocessing apparatus.

The folding unit 80 enlarged/shown in FIG. 4 is placed obliquely below the binding unit 70 in FIG. 3. After the saddle stitching process, the second abutting member 78 linearly moves toward the downstream in the convey direction of the bundle Sa of sheets to open the downstream path of the sheet path 77A. The movable second abutting member 78 regulates the stop position of the bundle Sa of sheets in the saddle stitching process at the upper position, and regulates the stop position of the bundle Sa of sheets in the center folding process at the lower position.

The bundle Sa of sheets constituted by the saddle-stitched cover paper K2 and sheets S is conveyed obliquely downward in a sheet convey path 81A formed by a guide plate 81. The end of the bundle Sa of sheets in the convey direction abuts against the second abutting member 78, so the bundle Sa of sheets stops at a predetermined position. The second abutting member 78 can be moved to the predetermined position in accordance with the sheet size setting operation or detection result and by a driving means.

The stacker 71 of the postprocessing unit 10 and the sheet paths 77A,. 77B, and 81A are formed in almost the same plane and form a sharp inclination of about 70° (see FIG. 3).

The folding unit 80 is comprised of a folding plate 82, first folding upper roller (to be referred to as an upper roller hereinafter) 83, first folding lower roller (to be referred to as a lower roller hereinafter) 84, second folding roller (to be referred to as a second roller hereinafter) 85, convey path switching member 87, guide plate 88, sheet leading end stopping member 89, and the like. The folding unit 80 performs a center folding process, i.e., a two-fold process, or a three-fold process for the sheet bundle Sa.

The upper and lower rollers 83 and 84 are supported by a pair of left and right pressing means which are substantially symmetric. One pressing means is formed of the upper roller 83, a support plate 832 which rotatably supports the upper roller 83 and is swingable about a support shaft 831 as the center, and a spring 833 which is locked at one end of the support plate 832 and biases the upper roller 83 toward the clamping position. The lower roller 84 is substantially symmetric with the upper roller 83, and is formed of a support shaft 841, support plate 842, and spring 843. The upper and lower rollers 83 and 84 are rotatably driven by a folding roller driving mechanism 801 (to be described later). The outer surfaces of the upper and lower rollers 83 and 84 are made of a material with a high frictional resistance.

Figure 5:
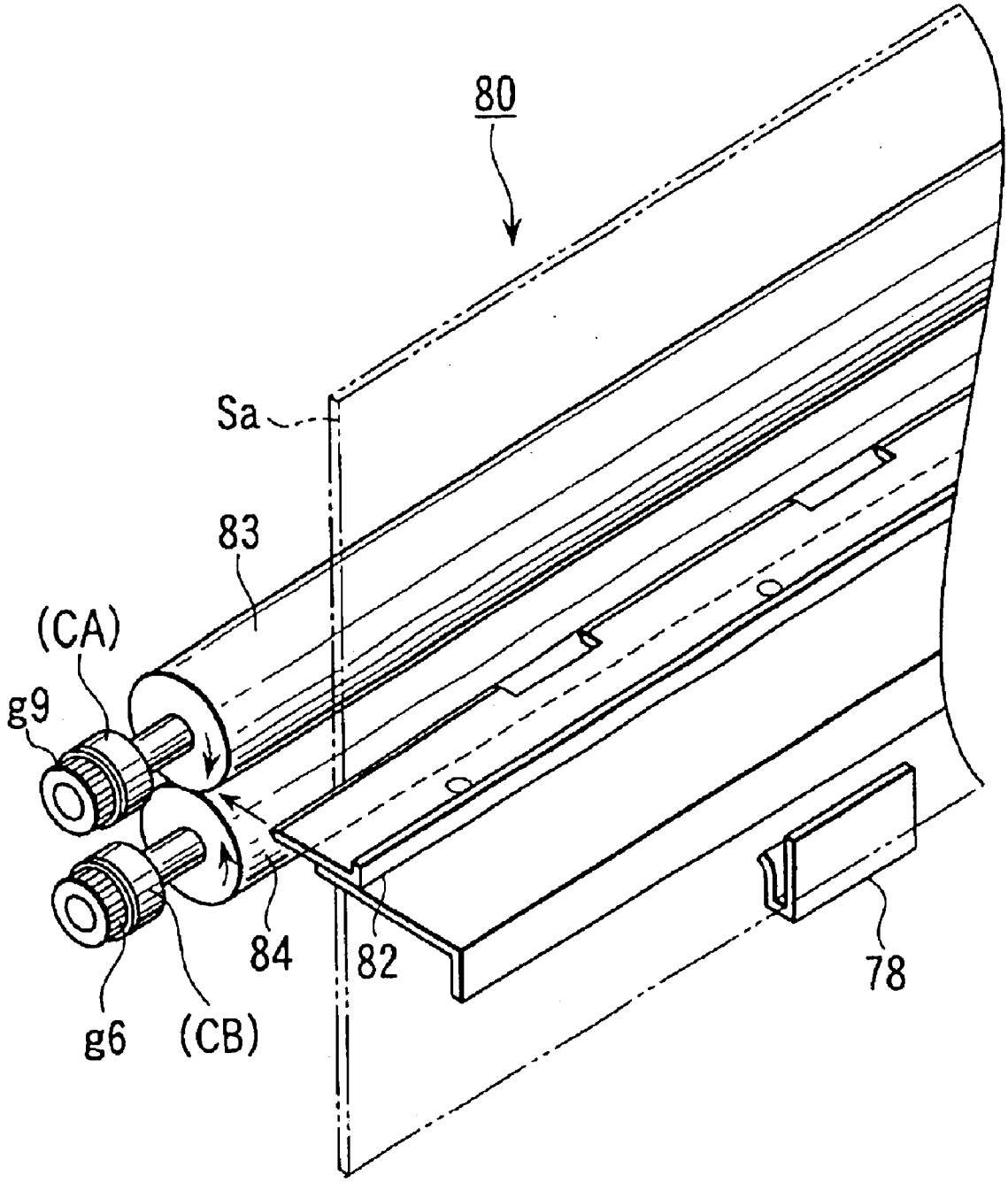
FIG. 5 is a perspective view showing the main part of the folding unit.

The convey path switching member 87 can be swung by a solenoid SD2. In a two-fold process, the convey path switching member 87 guides the delivered sheet S to a center-folding delivery outlet E1. In a three-fold process, the convey path switching member 87 guides the sheet S to the guide plate 88. FIG. 5 is a perspective view of the main part of the folding unit 80.

Driving Mechanism of Folding Unit

Figure 6:
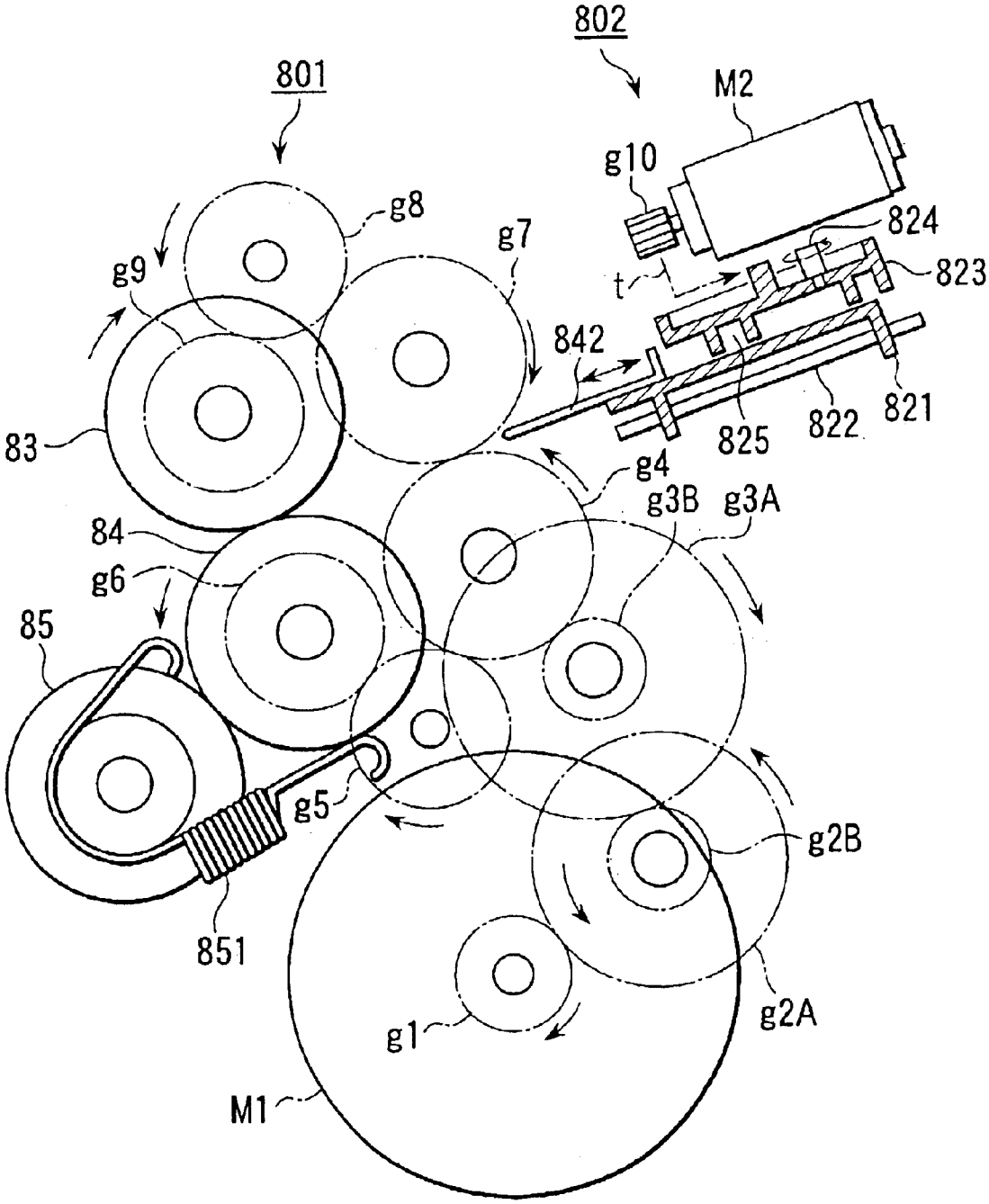
FIG. 6 is a view for explaining a folding roller driving mechanism and folding plate driving mechanism.

FIG. 6 shows the arrangements of the folding roller driving mechanism (first driving mechanism) 801 for rotating the upper and lower rollers 83 and 84 and second roller 85 of the folding unit 80 and of a folding plate driving mechanism (second driving mechanism) 802 for moving the folding plate 82. Note that the chain lines indicate the pitch circles of the gears.

A motor M1 rotates the lower roller 84 via a gear train constituted by gears g1, g2A, g2B, g3A, g3B, g4, g5, and g6. The motor M1 rotates the upper roller 83 via a gear train constituted by the gears g1, g2A, g2B, g3A, g3B, and g4 and gears g7, g8, and g9. The second roller 85 is pressed against the lower roller 84 by a spring 851 and rotates, following the lower roller 84.

A motor M2 rotates an eccentric cylindrical member 823 via a gear g10 and a drive transmission mechanism (indicated by a chain line t). The eccentric cylindrical member 823 eccentrically moves about an eccentric shaft 824 as the rotation center. A roller 825 extending upright from a movable holding member 821 rotatably comes into rolling contact with the inner wall of the eccentric cylindrical member 823.

The movable holding member 821 is so supported as to be rectilinearly reciprocable along two guide members 822 arranged parallel on a stationary board. When the eccentric cylindrical member 823 eccentrically moves upon rotation of the gear g10, the roller 825 moves, and the movable holding member 821 rectilinearly reciprocates along the two guide members 822. The folding plate 82 fixed on the movable holding member 821 also rectilinearly reciprocates together.

Center Folding Process for Sheets

Figure 7A:
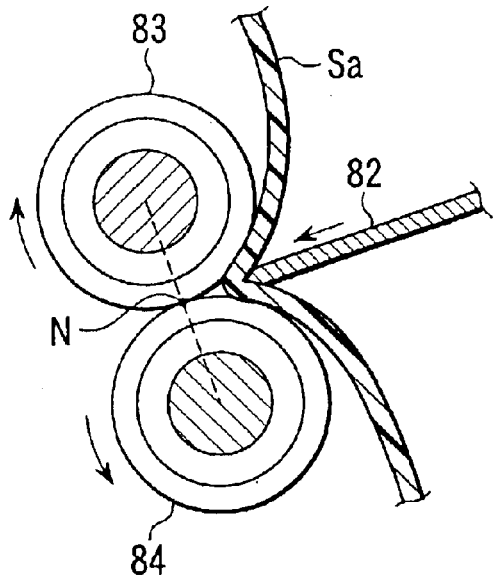
FIGS. 7A to 7C are sectional views showing a two-fold process in the folding unit.
Figure 7B:
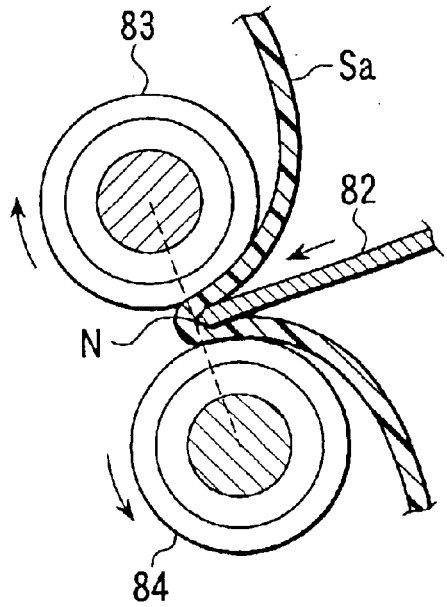
Figure 7C:
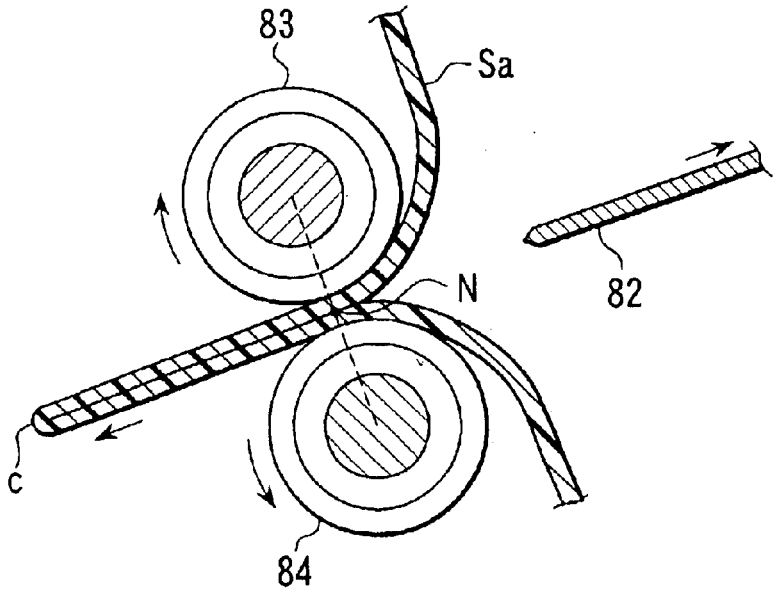

FIGS. 7A to 7C are sectional views showing a two-fold process by the folding unit 80. FIG. 7A shows a state wherein the folding plate 82 presses the sheet bundle Sa against the upper and lower rollers 83 and 84. FIG. 7B shows a state wherein the folding plate 82 moves beyond a clamping position N between the upper and lower rollers 83 and 84 to fold the sheet bundle Sa in two. FIG. 7C shows a state wherein the folding plate 82 retreats from the clamping position N between the upper and lower rollers 83 and 84 to return to the initial position, and the sheet bundle Sa folded in two is delivered from the upper and lower rollers 83 and 84.

In response to a two-fold process start signal, the folding plate 82 connected to the drive source protrudes from the sheet placing surface in the left direction shown in FIG. 7A. In this embodiment, the folding plate 82 has a thin knife-like shape having a thickness of about 0.3 mm with its edge portion having an acute angle.

The edge portion of the folding plate 82 that has moved rectilinearly and protruded in the left direction in FIG. 7A pushes the middle portion of the sheet bundle Sa, and causes the sheet bundle Sa to separate the upper and lower rollers 83 and 84 from each other at the clamping position N.

After the edge portion of the folding plate 82 passes through the clamping position N of the upper and lower rollers 83 and 84, the folding plate 82 retreats, and the middle portion of the sheet bundle Sa is pressed by the upper and lower rollers 83 and 84, thereby forming a fold c. This fold c almost coincides with the stapling position of a staple SP for the sheet bundle Sa.

The sheet bundle Sa on which the fold c is formed by pressing is conveyed by the rotating upper and lower rollers 83 and 84 and placed on the stationary delivery table 92 outside the apparatus.

Figure 8A:
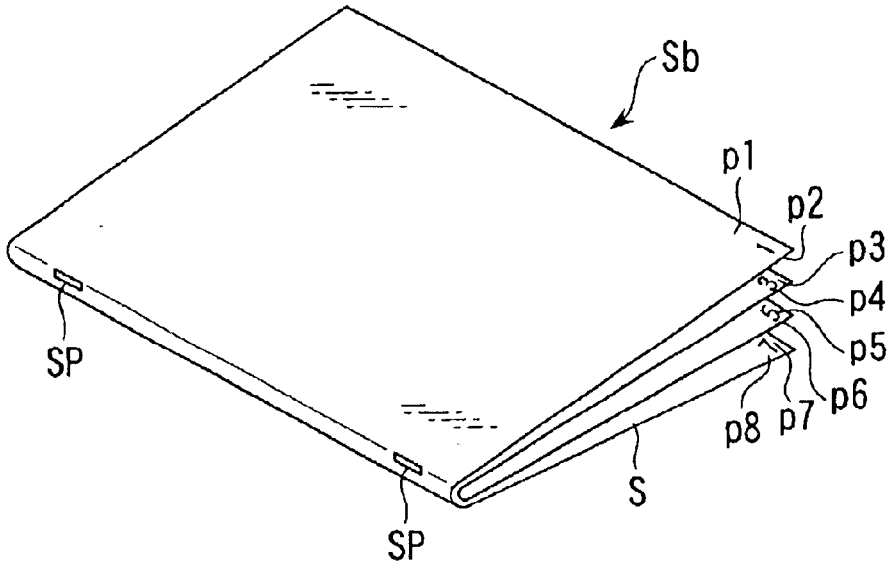
FIGS. 8A, 8B, and 8C are a perspective view of a sheet bundle having undergone postprocessing including a saddle stitching process and two-fold process, a perspective view showing a state wherein the sheet bundle is open, and a sectional view of the sheet bundle, respectively.
Figure 8B:
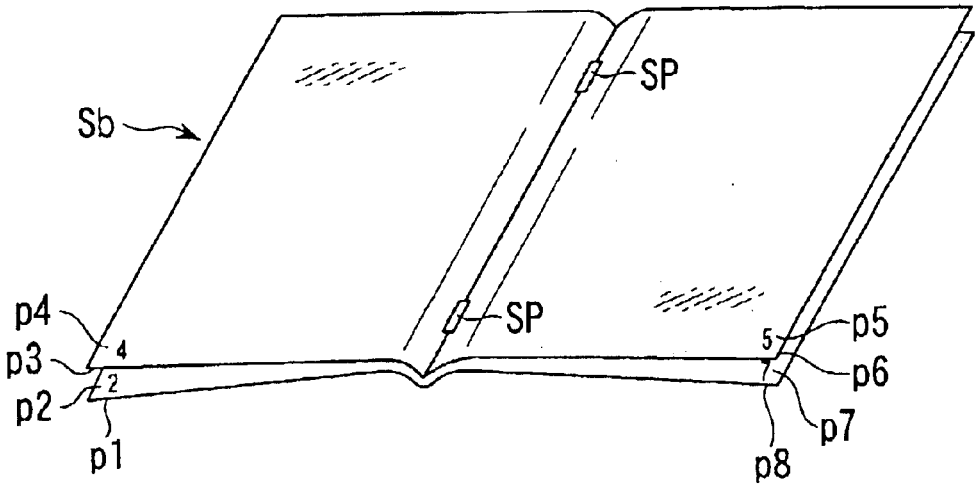
Figure 8C:
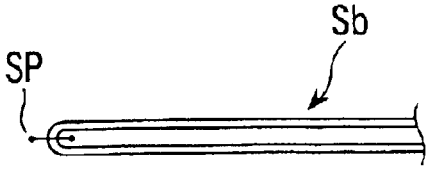

FIG. 8A is a perspective view of a sheet bundle Sb for which saddle stitching and a two-fold process have been performed. FIG. 8B is a perspective view of the postprocessed sheet bundle Sb in an open condition. FIG. 8C is a schematic sectional view of the sheet bundle Sb for which saddle stitching and a two-fold process have been performed.

In the sheet bundle Sb for which saddle stitching and a two-fold process have been performed, the first surface (pages 1 and 8) of the cover paper K2 faces outwardly, the second surface (pages 2 and 7) of the cover paper K2 is arranged on the lower side of the first page (pages 1 and 8), the first surface (pages 3 and 6) of the sheet S as the content is arranged inside the second page (pages 2 and 7), and the second surface (pages 4 and 5) of the sheets S is arranged inside the first surface (pages 3 and 6). Thus, the pages of the booklet Sb formed of 8 pages (pages 1 to 8) can be aligned as shown in FIGS. 8A to 8C.

Three-Fold Process

The folding unit 80 shown in FIG. 4 can execute two modes, i.e., a two-fold process and a three-fold process. The folding unit 80 has a first folding means for folding the sheet bundle Sa in two, and a second folding means for folding the sheet bundle Sa in three.

The first folding means is comprised of the upper roller 83, lower roller 84, and folding plate 82. The second folding means is comprised of the second roller 85, convey path switching member 87, guide plate 88, and sheet leading end stopping member 89.

The sheet leading end stopping member 89 is positioned such that the sheet convey distance from the clamping position N (see FIG. 7) of the upper and lower rollers 83 and 84 to the, sheet abutting surface of the sheet leading end stopping member 89 becomes ⅓ the length of the sheet S in the convey direction.

The lower roller 84 and second roller 85 are rotatably supported by the support plate 842 and connected to the first driving means 801 (see FIG. 6).

Figure 9A:
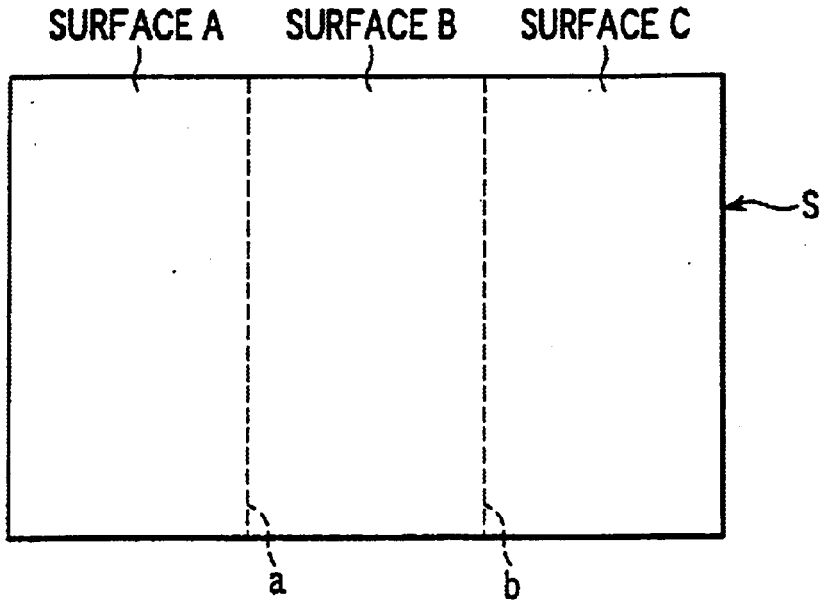
FIGS. 9A, 9B, and 9C are a plan view of a sheet subjected to a three-fold process, a perspective view of the sheet delivered with the upper surface facing down and folded in three, and a perspective view showing the sheet delivered with the upper surface facing up and folded in three, respectively.
Figure 9B:
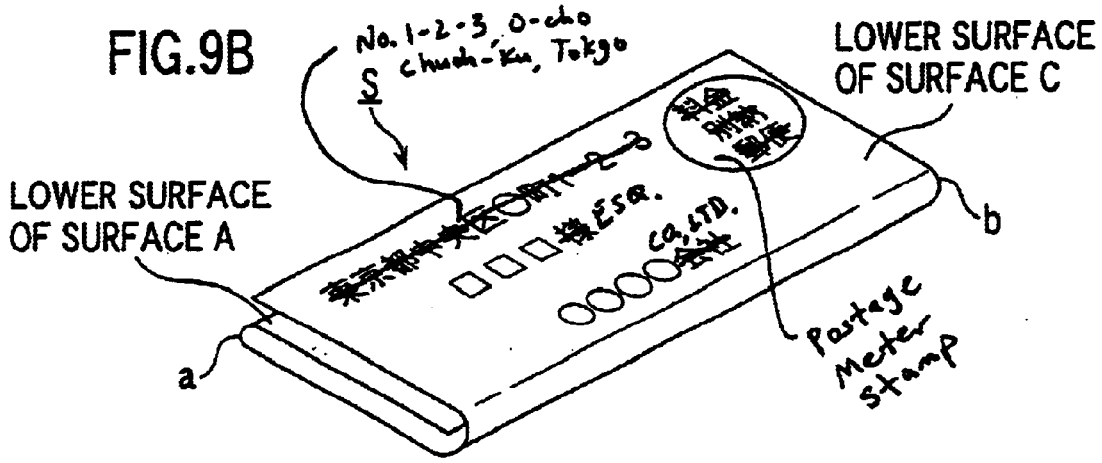
Figure 9C:
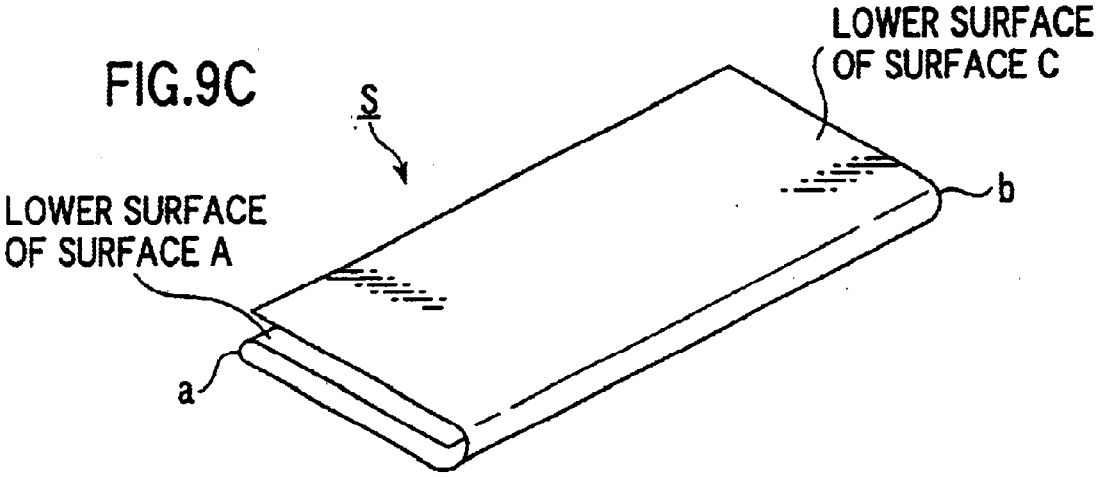

FIGS. 9A to 9C show the sheet S to be folded in three (see FIG. 9A) and the two sheets S in two conditions after three-fold processes (FIGS. 9B and 9C).

As shown in FIG. 9A, the sheet S is folded into three surfaces A, B, and C along folds a and b that divide the length of the sheet S in the longitudinal direction into three equal segments. The sheet S to be folded into three is folded along the fold a first, and then folded along the fold b.

The sheet S shown in FIG. 9B is folded in three such that the image-formed surface (upper surface), e.g., the address surface of direct mail, faces up, i.e., the non-image surface (lower surface) of the sheet S reversed and delivered from the image forming apparatus body A with its upper surface facing down is concealed inside. The sheet S shown in FIG. 9C is a sheet which is folded in three with the upper surface facing up after it is delivered from the image forming apparatus body A without being reversed when the text surface of a sheet like a letter which is the image-formed surface (upper surface) is preferred to be concealed inside.

Note that in a three-fold process, a predetermined number of sheets, e.g., three sheets in this embodiment, can be simultaneously folded in three. The sheet S folded in three can be put in an envelope as general mail. Although not shown, the sheet S subjected to a Z-fold process which is a kind of three-fold process can also be put in an envelope as general mail.

FIGS. 10A to 10D sequentially show the steps in a three-fold process.

In this three-fold process, inward folding shown in FIGS. 9B and 9C is performed. Referring to FIG. 9A, first of all, the sheet S is folded along the fold a such that the surfaces A and B face each other, and then folded along the fold b such that the surfaces C and A face each other.

Figure 10A:
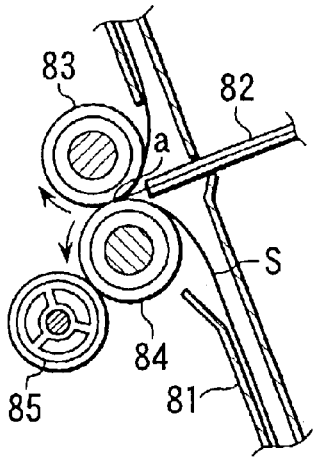
FIGS. 10A to 10D are sectional views showing a three-fold process.

(1) Referring to FIG. 10A, the edge portion of the folding plate 82 presses the fold a formed on the sheet S to insert it between the upper and lower rollers 83 and 84 at the clamping position N (see FIGS. 7A to 7C). The upper and lower rollers 83 and 84 rotate in the directions indicated by the solid arrows to clamp the sheet S while forming the fold a on the sheet S.

The folding plate 82 retreats from the clamping position N and returns to the initial position after the fold a is formed by the upper and lower rollers 83 and 84.

Figure 10B:
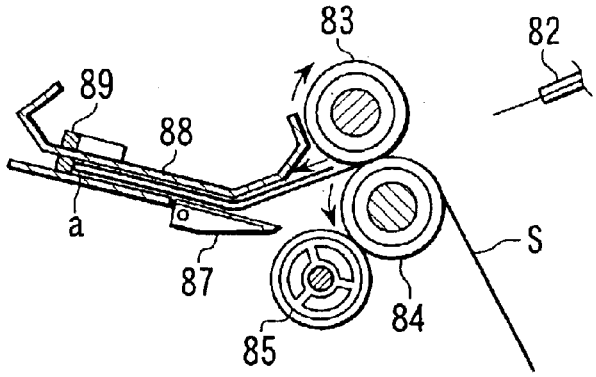

(2) As shown in FIG. 10B, the sheet S on which the fold a is formed between the upper and lower rollers 83 and 84 is conveyed in the direction indicated by the solid arrow by the rotating upper and lower rollers 83 and 84. The sheet S then moves along the upper surface of the convey path switching member 87, and passes through between the pair of opposing guide plates 88. As a consequence, the fold a of the sheet S abuts against the sheet leading end stopping member 89.

Figure 10C:
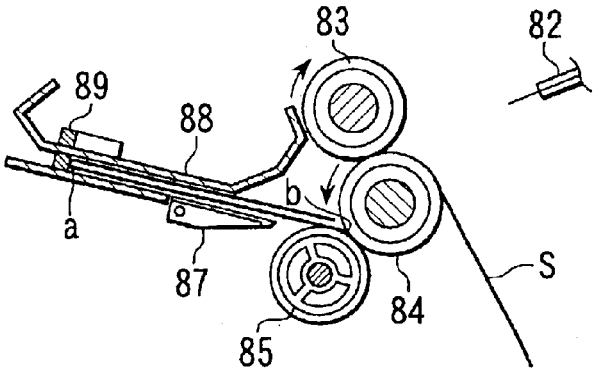

(3) As shown in FIG. 10C, as the upper and lower rollers 83 and 84 keep rotating, the fold a of the sheet S abuts against the sheet leading end stopping member 89, and so its onward movement is blocked. A trailing end portion of the sheet S which corresponds to ⅓ the length is wound around the outer surface of the lower roller 84 having a high frictional resistance and conveyed to the clamping position where the lower roller 84 is pressed against the second roller 85, thereby forming the fold b on the sheet S.

Figure 10D:
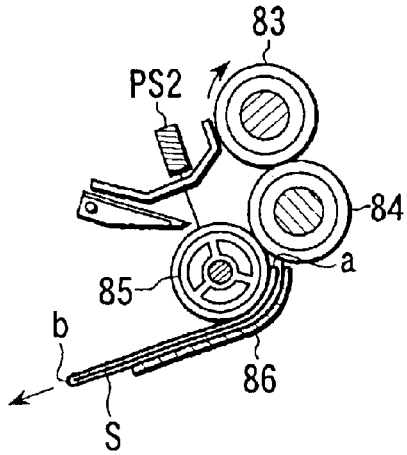

(4) As shown in FIG. 10D, the folds a and b are formed at the clamping position of the lower roller 84 and the second roller 85, and the sheet S folded in three is delivered onto the stationary delivery table 92 along a guide plate 86 with the leading and trailing ends being reversed.

An operation procedure at the operation display unit 9 formed by a liquid crystal display screen portion and conveyance and a three-fold process for the sheet S inside the image forming apparatus body A and postprocessing apparatus FS which accompanies this operation will be described next with reference to FIGS. 11 to 13.

Figure 11:
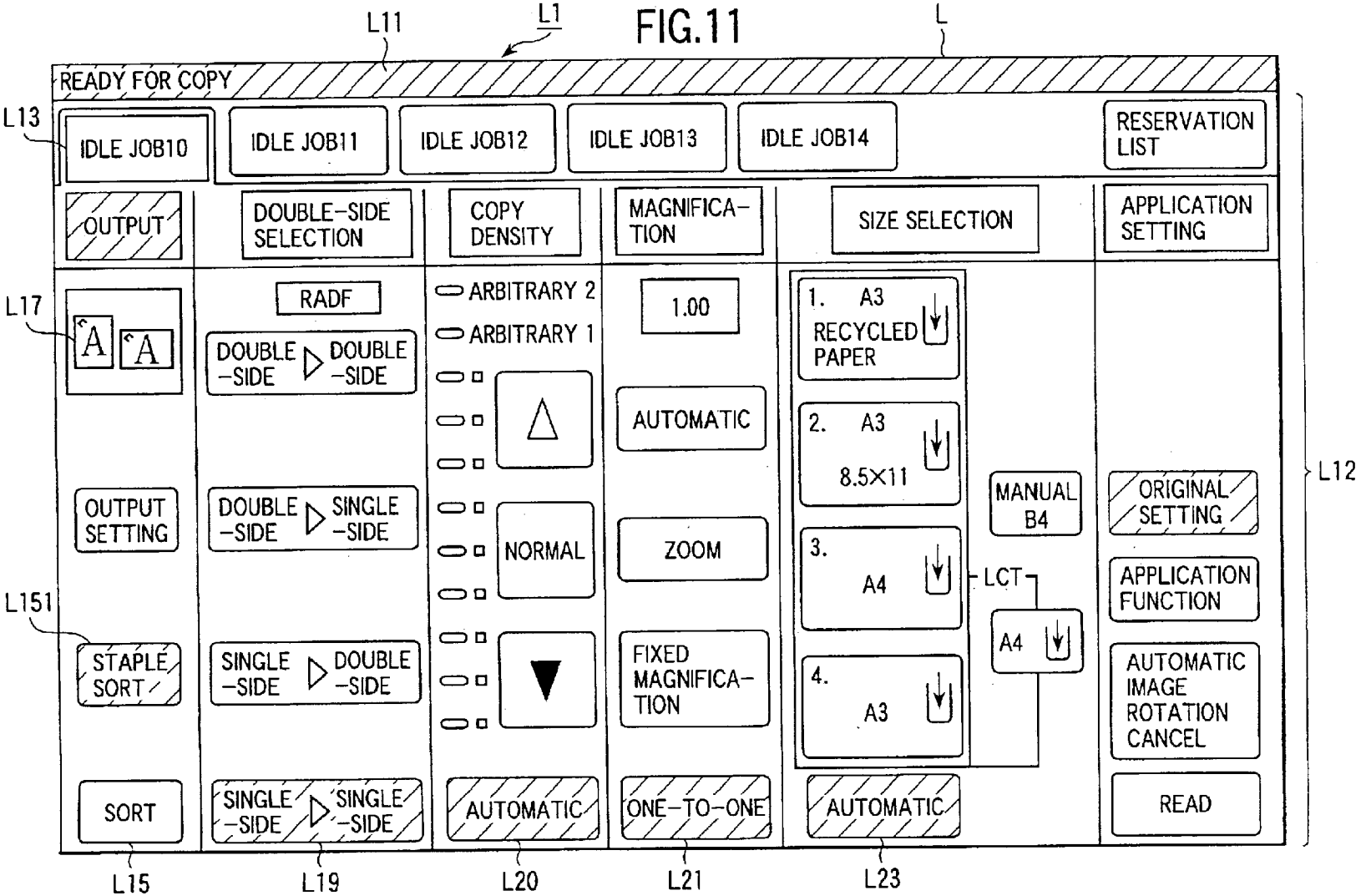
FIG. 11 is a view showing a basic window of a plurality of windows displayed on a liquid crystal display screen unit mounted on the upper portion of the image forming apparatus body.

The basic window shown in FIG. 11 is switched to a warm-up window (not shown) when the photosensitive body 1 shown in FIG. 1 is set in a copy-ready state after a power supply (not shown) is turned on.

As is obvious from FIG. 11, a basic window denoted by a reference symbol L1 is constituted by an elongated upper message display area L11 for highlighting the state of the image forming apparatus, a procedure, and the like (referring to FIG. 11, characters are expressed in black, and the background is expressed by hatching; this will apply to any portion that is expressed by "highlighting") and a lower window display area L12 which displays copy conditions and allows the operator to perform input setting operation.

The window display area L12 is constituted by various keys on a touch panel (to be described next).

These keys include an idle JOB group key L13 used to set copy conditions (when this JOB 10 key is highlighted upon touch, a key of another operation unit is also displayed in correspondence therewith, for example, like "staple sort" which is one of the keys of an output setting operation unit L15), the output setting operation unit L15, an output icon display unit L17, a double side selection setting operation unit L19 for setting a copy mode such as a "single-side to single-side" copy or "single-side to double-side" copy, a copy density setting operation unit L20 for copy density setting, a magnification setting operation unit L21 for selecting a magnification of 100× or fixed magnification or setting a zoom magnification, a size selecting operation unit L23 for selecting a copy sheet size.

When the operator touches an output setting key L151 located near the middle of the left end portion of the basic window L1 in FIG. 11, the output setting window L2 (FIG. 12) is displayed after being switched from the basic window L1 by a liquid crystal display screen unit L.

Figure 12:
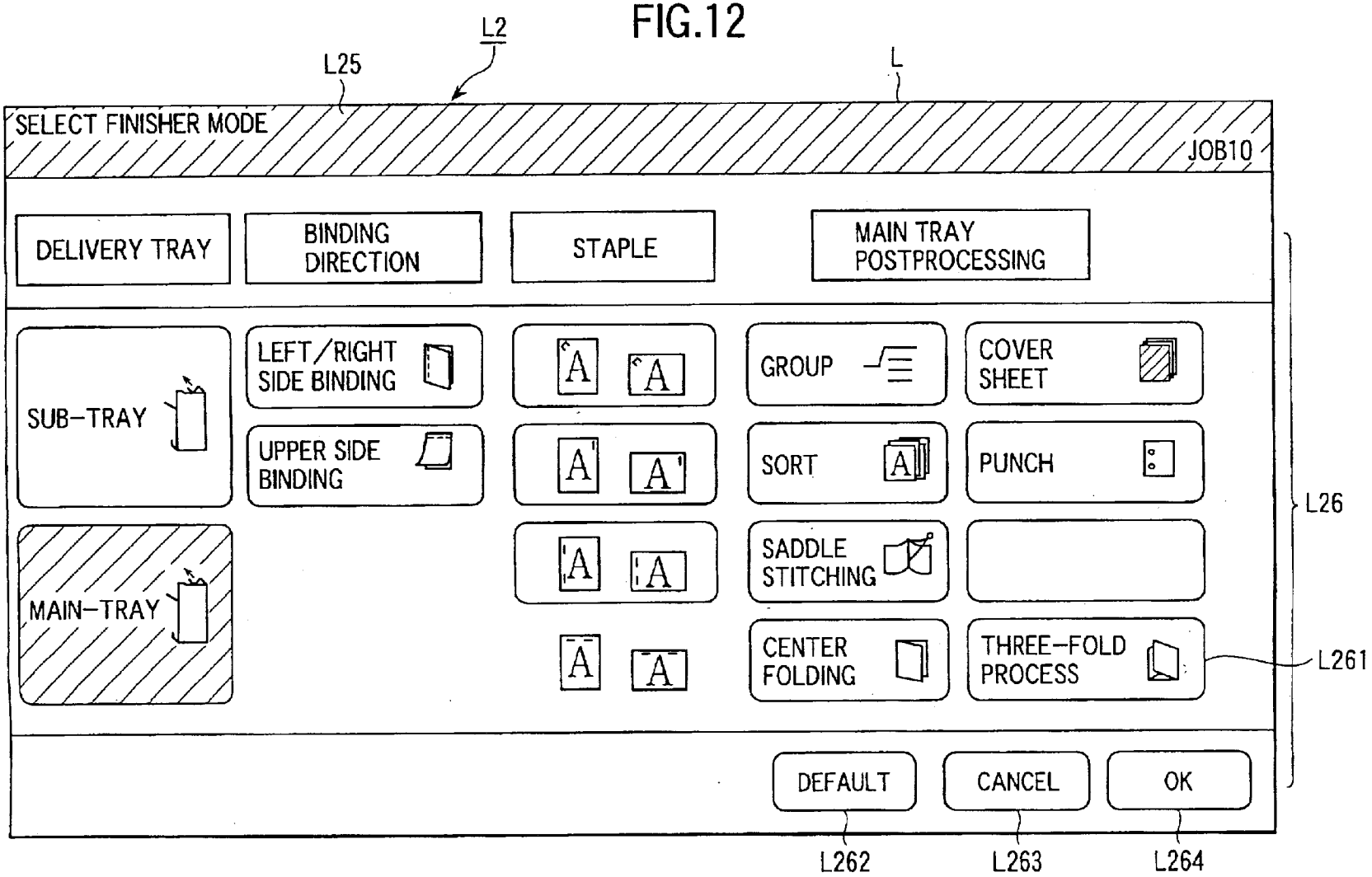
FIG. 12 is a view showing an output setting window on the liquid crystal display screen unit.

As is obvious from FIG. 12, the output setting window L2 is constituted by an elongated upper message display area L25 and a lower window display area L26 which allows the operator to perform various input setting operations.

The window display area L26 is constituted by various keys on the touch panel described next.

These keys include keys (a three-fold key L261 and the like) which allow the operator to select modes in "delivery tray", "binding direction", "staple", and "main tray postprocessing", a return key L262 which is located on the right side of the lower portion and is used to set the mode of each operation unit in a standard state, a cancel key 263 which is used to cancel a selected mode, an OK key L264 which is used to return to the basic window L1, and the like.

When the operator touches the three-fold key L261 on a lower portion of the right end in FIG. 12 to set the corresponding mode (the three-fold key L261 is highlighted), a fold surface selection window is displayed after being switched from the output setting window L2 by the liquid crystal display screen unit L.

Figure 13:
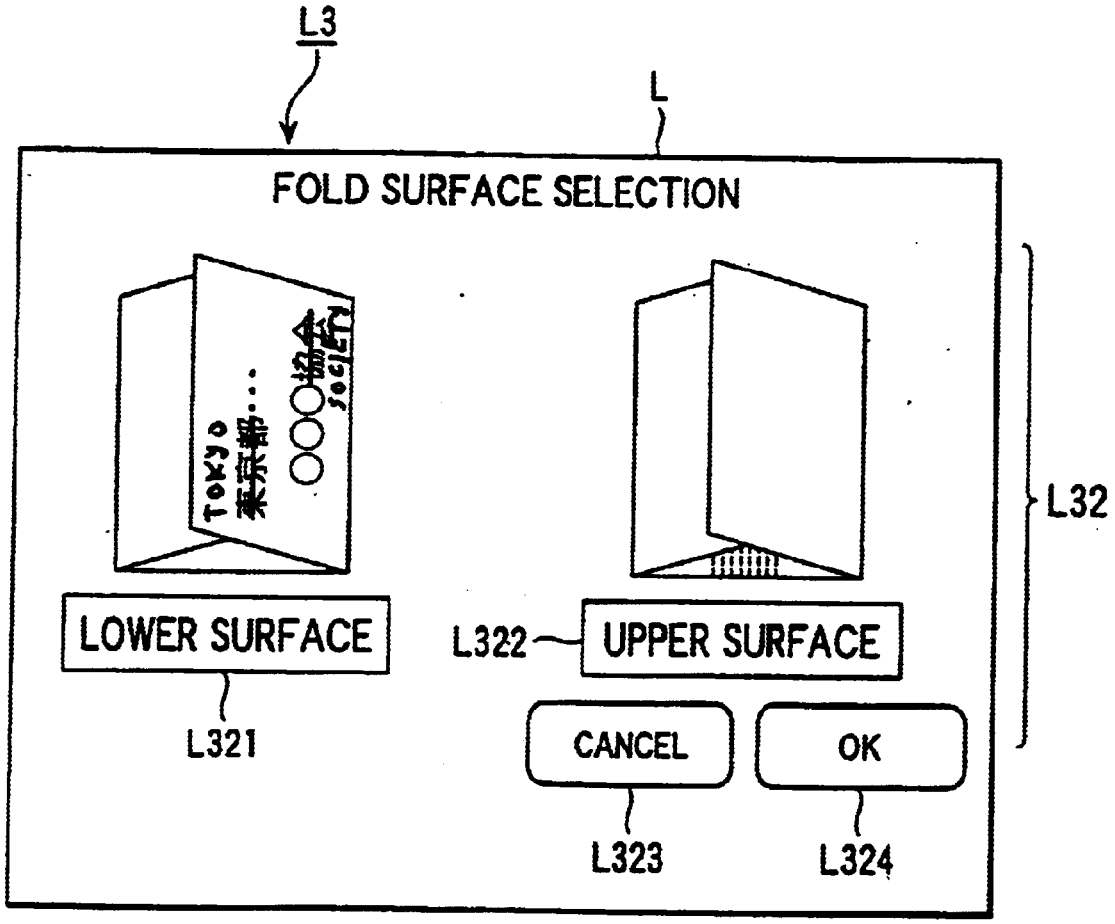
FIG. 13 is a view showing a fold surface selection window on the liquid crystal display screen unit.

As is obvious from FIG. 13, the fold surface selection window denoted by reference symbol L3 is formed from a window display area L32 having two mode keys, i.e., a lower surface key L321 and upper surface key L322 which are located on a middle portion of the window display area and allow the operator to select a fold surface, a cancel key L323 which is located on the lower right side and is used to cancel a set mode, and an OK key L324 for returning to the output setting window L2 in FIG. 12.

When the lower surface key L321 is selected, the convey path switching plate 7D formed in a convey path in the image forming apparatus body A shown in FIG. 1 is switched/controlled to allow the sheet S to be conveyed to a convey path formed on the convey roller 7F side.

After the conveyed sheet S moves downward through the convey rollers 7F, the sheet S is switched back to be reversed. The sheet S then moves upward with its trailing end at the front and is conveyed from the delivery unit 7C to the postprocessing apparatus FS with the image-formed surface (upper surface) facing down, thereby performing a folding process.

In other words, the sheet S is conveyed to the folding unit 80 with the image-formed surface (upper surface) facing down to allow a three-fold process such that the non-image surface (lower surface) is folded inside.

When the upper surface key L322 is selected, the sheet S moves along a convey path formed above the convey path switching plate 7D in the image forming apparatus body A shown in FIG. 1, and is conveyed to the postprocessing apparatus FS through the delivery unit 7C, thereby performing a three-fold process.

In other words, the sheet S is conveyed to the folding unit 80 with the image-formed surface (upper surface) facing up to allow a three-fold process such that the image-formed surface is folded inside.

As described above, in order to return to the basic window L1 for starting copy operation after the window is switched to the basic window L1, output setting window L2, and fold surface selection window L3 and predetermined modes are set, the OK keys set in the respective windows may be touched in the reverse order.

Figure 14:
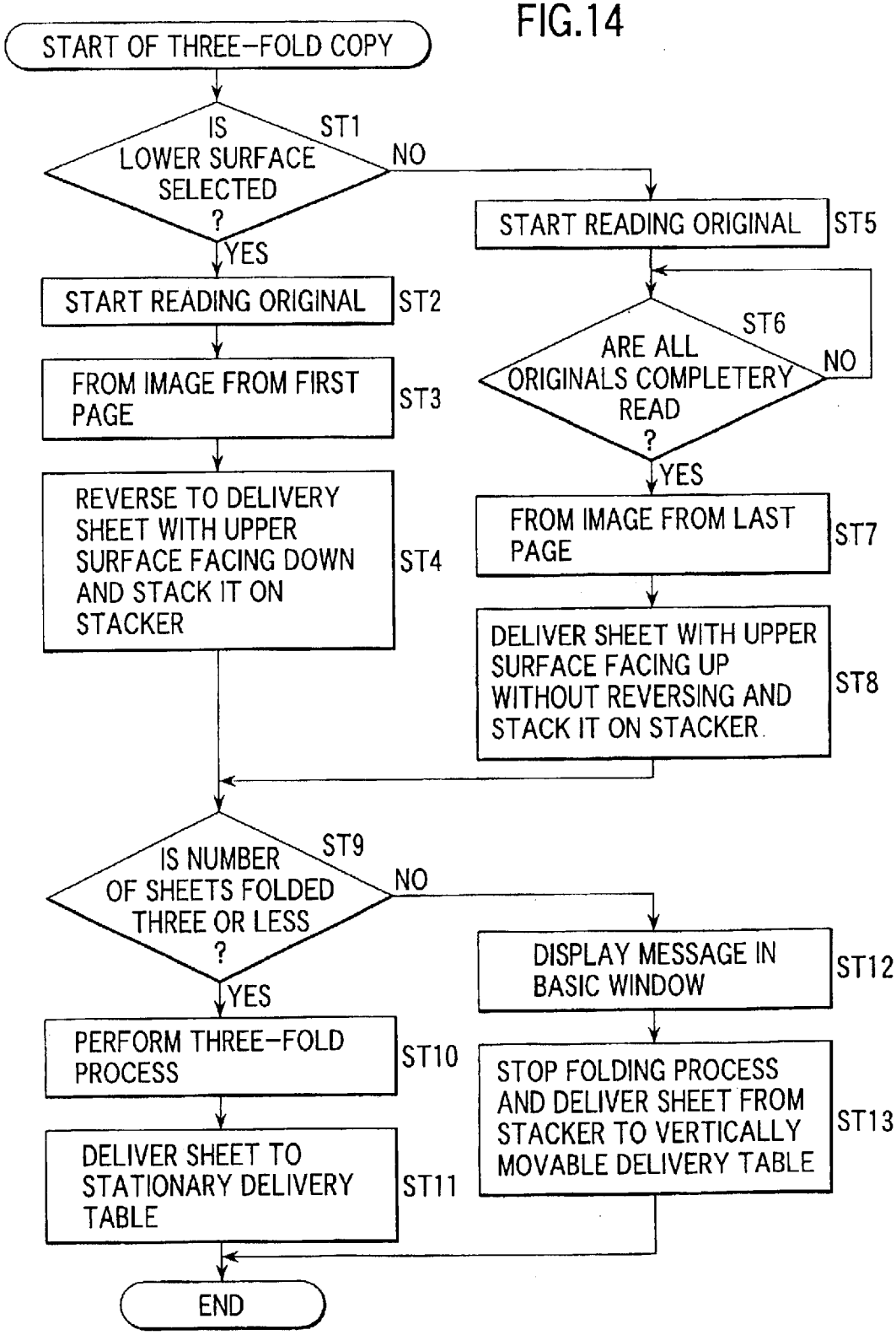
FIG. 14 is a flow chart showing an example of control to be performed by a control means when a three-fold mode is selected according to the first embodiment.

FIG. 14 is a flow chart showing an example of control to be performed by the control means when the three-fold mode is selected according to the first embodiment of the present invention.

After copy conditions are set in the basic window L1, originals are placed on a feeder table B1 (see FIG. 1) on the upper portion of the image reading apparatus B. Copy operation is then started by pressing the start button (not shown) on the operation display unit 9.

As shown in FIG. 14, if lower surface key L321 is selected in the fold surface selection window L3 (YES in step ST1), the image reading apparatus B starts reading the originals (step ST2), and all the originals are sequentially read.

If data can be output from a memory after the original reading operation is started in step ST2, image formation (step ST3) is sequentially performed from the first page while the subsequent page is read.

A toner image is transferred onto the sheet S fed from the sheet storing means 7A at the transfer position. The toner image is fixed by the fixing means 8. The sheet S travels on the convey path formed along the convey path switching plate 7D and convey rollers 7F and is conveyed by the reverse convey rollers 7G until the trailing end of the sheet S is detected by a detector (not shown) placed near the convey rollers 7F. The sheet S is then switched back to be reversed and conveyed and moves upward with the trailing end at the front. The sheet S is delivered from the delivery unit 7C with the image-formed surface (upper surface) facing down and conveyed and stacked on the stacker 71 of the postprocessing apparatus FS (step ST4).

That is, the sheet S is reversed and delivered with the upper surface facing down by the image forming apparatus body A and is conveyed and stacked on the stacker 71 of the postprocessing apparatus FS.

If the upper surface key L322 is selected in the fold surface selection window L3 (NO in step ST1), the image reading apparatus B starts reading operation (step ST5) and keeps reading until all the originals are read (step ST6).

After all the originals are completely read, the last page data is output from the memory, and image formation is performed from the last page (step ST7).

A toner image is transferred onto the sheet S fed from the sheet storing means 7A at the transfer position. The toner image is fixed by the fixing means 8. The sheet S then travels along the convey path formed above the convey path switching plate 7D so as not be reversed, and delivered from the delivery unit 7C with the image-formed surface (upper surface) facing up. The sheet S is then conveyed and stacked on the stacker 71 of the postprocessing apparatus FS (Step ST8).

That is, the sheet S is delivered with the upper surface facing up without being reversed by the image forming apparatus body A, and is conveyed and stacked on the stacker 71 of the postprocessing apparatus FS.

After the sheet S is stacked on the stacker 71 in step ST4 or ST8, it is checked whether the number of sheets is equal to or less than a predetermined number that allows a three-fold process, e.g., three (step ST9). If the number of sheets is equal to or less than the predetermined number, the sheets are conveyed to the three-fold process unit described with reference to FIG. 10 (step ST10), and the sheets Sb folded in three are delivered to the stationary delivery table 92 (step ST11).

If it is determined in step ST9 that the number of sheets exceeds the predetermined number, for example, the message "The number of sheets that can be folded in three at once is limited to three or less. The three-fold process is canceled." (step ST12), and at the same time, the sheets stacked on the stacker 71 are delivered to the vertically movable delivery table 91, which is different from the delivery table used in a three-fold process, through the convey path formed by the delivery means 60 (step ST13).

Figure 15:
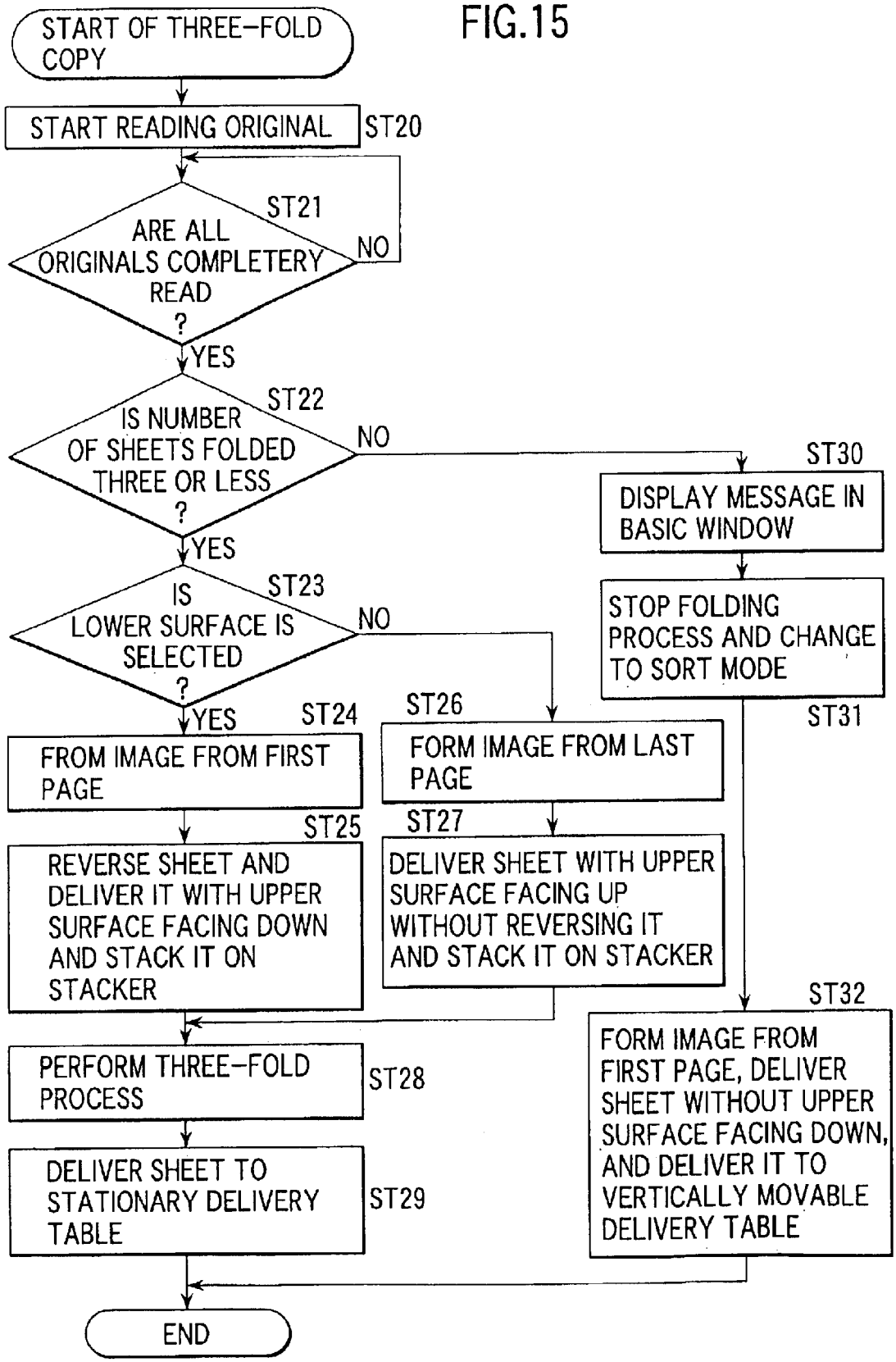
FIG. 15 is a flow chart showing an example of control to be performed by a control means when a three-fold mode is selected according to the second embodiment.

FIG. 15 is a flow chart showing an example of control to be performed by a control means when the three-fold mode is selected according to the second embodiment of the present invention.

The second embodiment differs from the first embodiment in that the number of sheets to be subjected to a three-fold process is determined on the basis of original read information, and if the number of sheets exceeds the maximum number of sheets that can be folded in three at once, the three-fold mold is changed to another mode, e.g., the sort mode, and image formation and sheet delivery are controlled.

As in the first embodiment, when three-fold copy operation is started, the image reading apparatus B starts reading originals (step ST20), and keeps reading until all the originals are completely read (step ST21).

After all the originals are completely read, it is checked, on the basis of the number of sheets read which is stored in the memory, whether the number of sheets to be processed is equal to or less than a predetermined number, e.g., three (step ST22). If the number of sheets is equal to or less than the predetermined number, it is checked whether the lower surface key has been selected in a fold surface selection window L3 (step ST23).

If the lower surface key has been selected (YES in step ST23), image formation is performed from the first page in steps ST24 and ST25 as in steps ST3 and ST4 in FIG. 14, and the sheets are reversed and delivered with the upper surfaces facing down. The sheets are then stacked on a stacker 71.

If it is determined in step ST23 that an upper surface key L322 has been selected in the fold surface selection window L3 (NO in step ST23), image formation is performed from the last page in steps ST26 and ST27 as in steps ST7 and ST8 in FIG. 14, and the sheets are delivered without being reversed with the upper surfaces facing up. The sheets are then stacked on the stacker 71.

After sheets S are stacked on the stacker 71 in step ST25 or ST27, the sheets are conveyed to a three-fold process unit and subjected to a three-fold process in steps ST28 and ST29 as in steps ST10 and ST11 in FIG. 14 (step ST28). Sheets Sb folded in three are delivered to a stationary delivery table 92 (step ST29).

If it is determined in step ST22 that the number of sheets exceeds the predetermined number, for example, the message "The number of sheets that can be folded in three at once is limited to three or less. The three-fold process is canceled." (step ST30). At the same time, the three-fold process is stopped, the three-fold mode is switched to another mode, e.g., the sort mode, and the sort mode is executed (step ST31).

In the sort mode, image formation is performed from the first page, and the sheets are reversed and delivered with the upper surfaces facing down. The sheets are then delivered to a vertically movable delivery table 91 through a second convey path ②, the convey path formed by a delivery means 60, and a convey path different from that used in the three-fold process (step ST32).

Further, in both the first and the second embodiments of the present invention, each of the control systems shown in FIGS. 14 and 15 is stored in the memory as a program. In accordance with the program stored in the memory, a calculation means such as, for example, a CPU, etc., is allowed to perform processing. The image forming apparatus body A, the postprocessing apparatus FS, etc., are respectively controlled on the basis of the performance result through an interface (I/O).

Figure 16A:
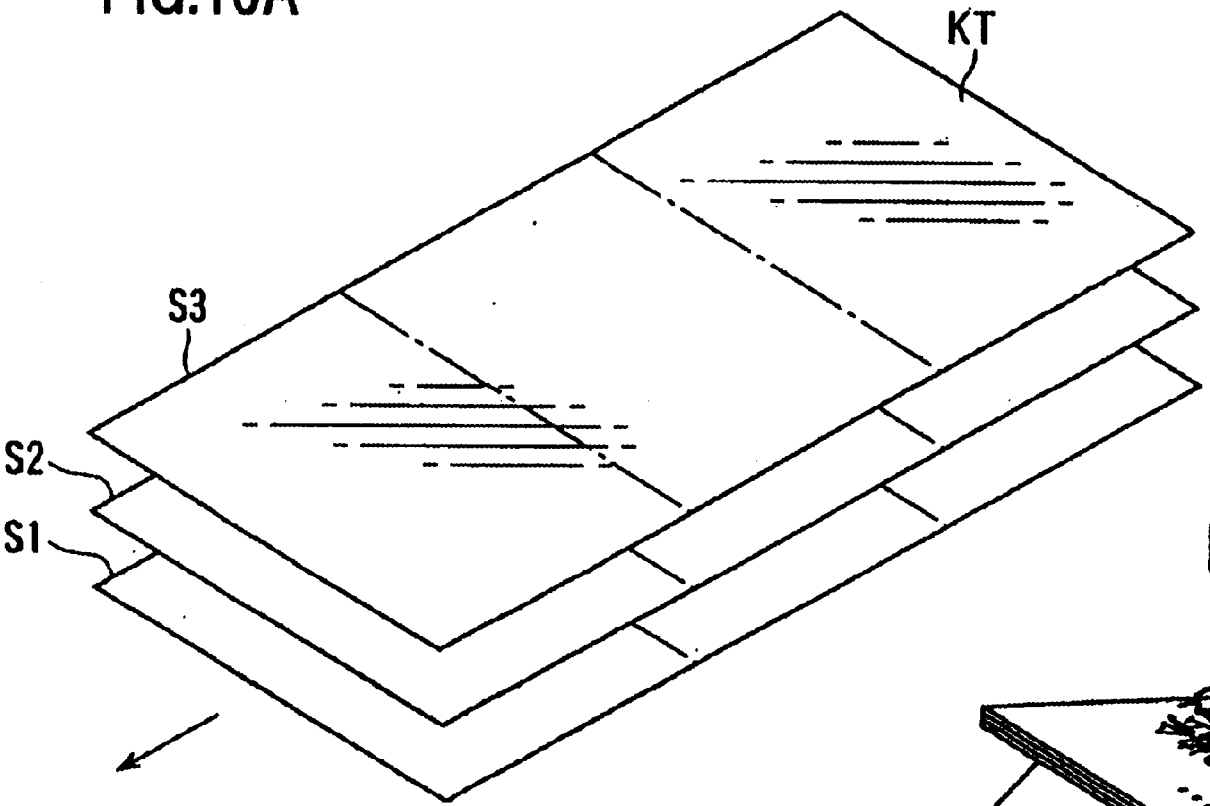
FIGS. 16A and 16B are views showing how a plurality of stacked sheets delivered with the upper surfaces facing down are conveyed and folded in three.
Figure 16B:
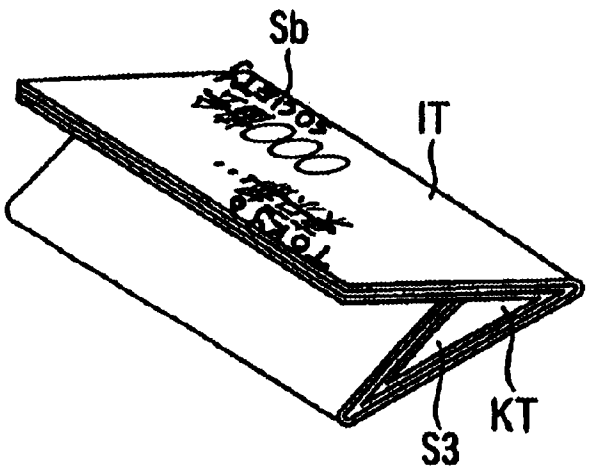

FIG. 16A is a perspective view showing a state wherein the sheets S are delivered with the image-formed surfaces facing down. FIG. 16B is a perspective view showing a state immediately before the completion of a three-fold process.

As shown in FIG. 16A, sheets S1, S2, and S3 which are switched back to be reversed after fixing in the original reading order travel in the direction indicated by the arrow in this order, conveyed through sheet convey paths 13A and 13B described with reference to FIGS. 2 and 3, and stacked on the stacker 71. After the sheets are aligned by a width aligning member 73, a second abutting member 78 on which a bundle of sheets S1, S2, and S3 is stacked is moved to a predetermined position where a three-fold process is performed. At this position, the sheets are folded in three along the folds indicated by the chain lines.

Reference symbol KT denotes a non-image surface (lower surface); and IT, an image-formed surface (upper surface).

As shown in FIG. 16B, the sheet bundle Sb which is folded in three while the image-formed surface IT, i.e., an address surface ("Tokyo . . . "), appears on the upper surface of the sheet bundle is delivered to a stationary delivery table 92.

Figure 17A:
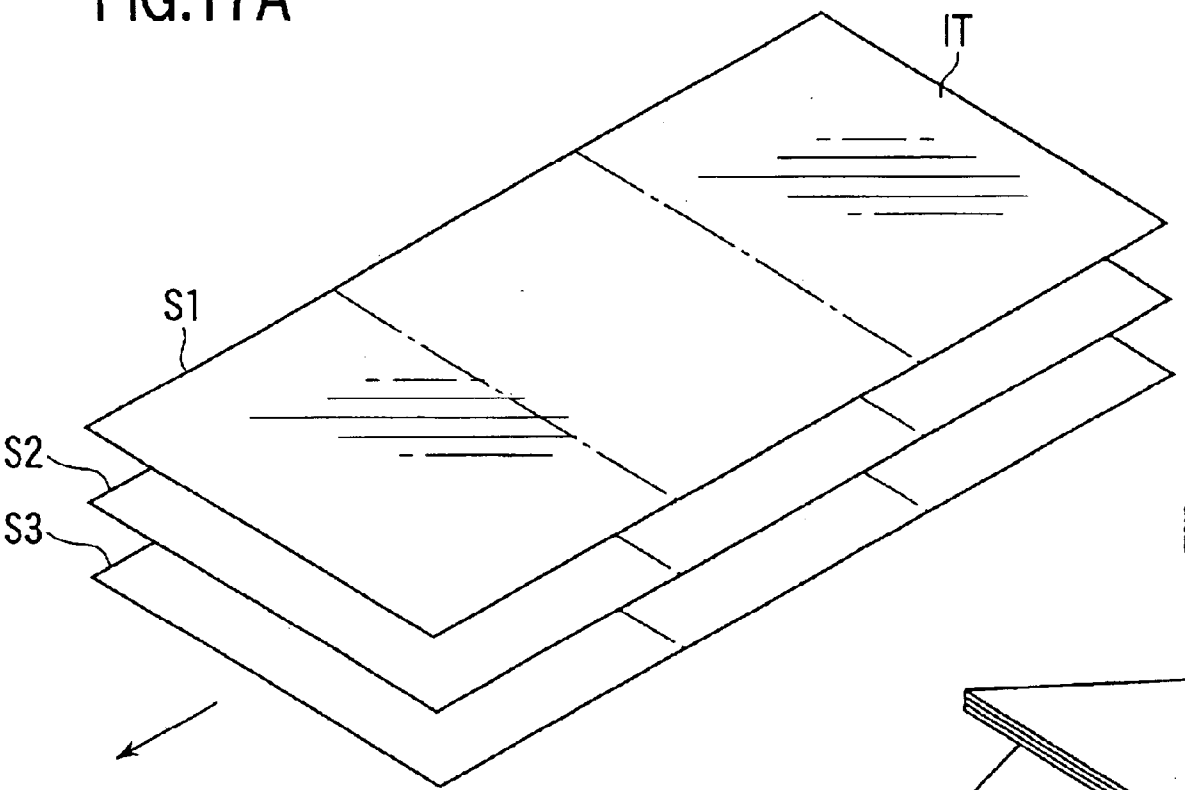
FIGS. 17A and 17B are views showing how a plurality of stacked sheets delivered with the upper surfaces facing up are conveyed and folded in three.
Figure 17B:
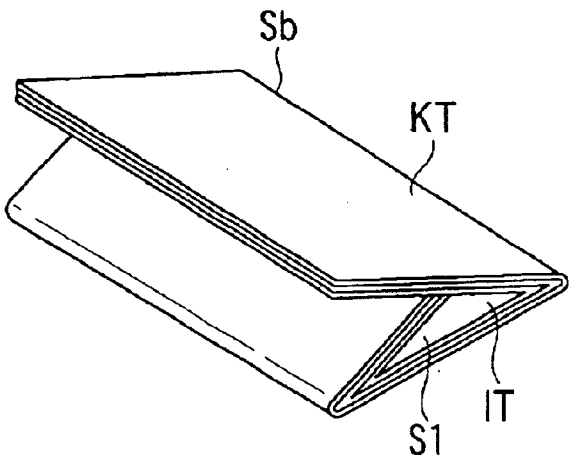

FIG. 17A is a perspective view showing a state wherein the sheets S are delivered with the image-formed surfaces facing up. FIG. 17B is a perspective view showing a state immediately before the completion of a three-fold process.

As shown in FIG. 17A, after image formation is sequentially performed from the last page and the images are fixed, the sheets S3, S2, and S1 travel in the direction indicated by the arrow in the order named. These sheets are conveyed through the sheet convey paths 13A and 13B described with reference to FIGS. 2 and 3, and stacked on the stacker 71. After the sheets are aligned by the width aligning member 73, the second abutting member 78 on which a bundle of sheets S3, S2, and S1 is stacked is moved to the predetermined position where a three-fold process is performed. At this position, the sheets are folded in three along the folds indicated by the chain lines.

As shown in FIG. 17B, the sheets S1, S2, and S3 on which the text of a letter is copied are folded in three such that the non-image surface (lower surface) KT appears on the upper surface of the sheet bundle Sb, and the image-formed surface IT comes inside, and the sheets S1, S2, and S3 are delivered to the stationary delivery table 92 while they are stacked on each other in the order named.

The sheet S is folded in three by moving a folding plate 82 from the right as in a folding unit 80 shown in FIGS. 1 to 3. However, in the case of the folding unit 80 capable of folding a sheet in three by moving the folding plate 82 from the opposite direction, two mode keys, i.e., a lower surface key L321 and upper surface key L322 in a fold surface selection window L3 shown in FIG. 13 may be interchanged.

As in the present invention, by selecting a fold surface using a lower surface key and upper surface key, the sheet S can be controlled to be delivered to a postprocessing apparatus FS in either of the state wherein the image-formed surface faces down or the state wherein the image-formed surface faces up.

In a three-fold process performed by the folding unit, a sheet can be folded in three either from the upper surface or from the lower surface.

The present invention is suitable for a case wherein a sheet bundle folded in three with an address surface appearing on the upper surface is inserted into an envelope to be mailed like direct mail, or a case wherein a sheet bundle folded with the text located inside is preferably inserted into an envelope to be mailed like a letter.

According to the present invention, there is provided an image forming apparatus which can easily meet requirements corresponding to various applications.

What is claimed is:

1. An image forming apparatus including an image forming apparatus body, an image reading apparatus mounted on an upper portion of the apparatus body, and a postprocessing apparatus having a folding unit which folds a sheet, comprising:

a selection window which is formed on an operation display unit of the image froming apparatus and allows selection of a fold surface of a sheet, and control means for conveying an image-formed sheet to areversing unit for reversing the sheet and/or to the folding unit, said control means performing control to reverse the sheet and conveying the sheet to the folding unit when a three fold process of folding a lower surface is selected from said selection window, wherein the selection window displays a three-fold process of folding an upper surface on which an image is formed and a three-fold process of folding a lower surface on which no image is formed.

2. An apparatus according to claim 1, wherein the folding unit performs a three-fold process.

3. An apparatus according to claim 1, further comprising control means for conveying an image-formed sheet to a reversing unit for reversing the sheet and/or to the folding unit, said control means performing control to convey the sheet to the folding unit without reversing the sheet when the three-fold process of folding an upper surface is selected from said selection window.

4. An apparatus according to claim 3, wherein said control means performs control to sequentially read all originals by the image reading apparatus when a plurality of sheets are folded in three.

5. An apparatus according to claim 3, wherein said control means comprises a main control unit and postprocessing control means for the postprocessing apparatus.

6. An apparatus according to claim 4, wherein said control means performs control to perform image formation from the last page of the plurality of sheets and then convey the sheets to the folding unit.

7. An apparatus according to claim 4, wherein said control means performs control to stop a three fold process when the number of sheets to be subjected to the three fold process in the folding unit exceeds a predetermined number.

8. An apparatus according to claim 1, wherein said control means performs control to sequentially read all originals by the image reading apparatus when a plurality of sheets are folded in three.

9. An apparatus according to claim 8, wherein said control means performs control to sequentially perform image formation from the first page of the plurality of sheets and then convey the sheets to the folding unit.

10. An apparatus according to claim 8, wherein said control means performs control to stop a three fold process when the number of sheets to be subjected to the three fold process in the folding unit exceeds a predetermined number.

11. An apparatus according to claim 1, wherein said control means comprises a main control unit and postprocessing control means for the postprocessing apparatus.

* * * * *